US010049649B2

(12) United States Patent
Kimura

(10) Patent No.: US 10,049,649 B2
(45) Date of Patent: Aug. 14, 2018

(54) BOWED STRING INSTRUMENT

(71) Applicant: Takumi Kimura, Gunma (JP)

(72) Inventor: Takumi Kimura, Gunma (JP)

( * ) Notice: Subject to any disclaimer, the term of this patent is extended or adjusted under 35 U.S.C. 154(b) by 2 days.

(21) Appl. No.: 15/322,035

(22) PCT Filed: Jul. 3, 2015

(86) PCT No.: PCT/JP2015/069257
§ 371 (c)(1),
(2) Date: Dec. 23, 2016

(87) PCT Pub. No.: WO2016/013385
PCT Pub. Date: Jan. 28, 2016

(65) Prior Publication Data

US 2017/0140742 A1 May 18, 2017

(30) Foreign Application Priority Data

Jul. 25, 2014 (JP) ..... 2014-151389

(51) Int. Cl.
*G10D 3/18* (2006.01)
*G10D 1/02* (2006.01)

(52) U.S. Cl.
CPC ..... *G10D 3/18* (2013.01); *G10D 1/02* (2013.01)

(58) Field of Classification Search
CPC ..... G10D 1/02; G10D 3/00
See application file for complete search history.

(56) References Cited

U.S. PATENT DOCUMENTS 2,782,670 A * 2/1957 Lipski ..... G10D 3/166 84/283
4,606,255 A 8/1986 Hayashi et al.
7,084,337 B1 8/2006 Schroeder
2014/0290460 A1* 10/2014 Vochezer ..... G10D 3/18 84/280

FOREIGN PATENT DOCUMENTS

JP 57-054190 U 3/1982
JP 58-168793 U 11/1983
JP 3039706 U 5/1997
JP 2000-099003 A 4/2000
JP 2000-200082 A 7/2000
JP 2005-283732 A 10/2005
JP 2006-293055 A 10/2006
JP 2006-317917 A 11/2006

* cited by examiner

*Primary Examiner* — Kimberly Lockett
(74) *Attorney, Agent, or Firm* — Novick, Kim & Lee, PLLC; Jae Youn Kim

(57) ABSTRACT

The present invention provides a bowed string instrument that allows a player to hold it in a stable manner and to handle a bow and strings without much effect. A bowed string instrument 1 has a body 102, a shoulder pad 103 connected to the body 102, a body receiver 106 disposed below the body 102 so as to receive a load of the body, and an operative joint portion 107 coupling the body 102 and the body receiver 106 to each other while allowing the body 102 to be slidable on a spherical surface. The body 102 includes a fingerboard 105, a plurality of strings 104 extending above the fingerboard 105, and a pair of bridges for supporting and tensioning the plurality of strings 104 above the fingerboard 105.

30 Claims, 25 Drawing Sheets

BOWED STRING INSTRUMENT

TECHNICAL FIELD

The present invention relates to a bowed string instrument, and more particularly to a bowed string instrument that produces sound by rubbing one or more strings with a bow or the like.

BACKGROUND ART

Violins have widely been used for dance music, concertos, and the like because they produce gorgeous sound. Thus, a violin is a well-known bowed string instrument that produces sound by rubbing one or more strings with a bow or the like. Although violin music is very popular, the number of violinists is quite fewer than the number of players who play other string instruments such as guitars.

The primary reasons why the above-mentioned situation arises are as follows: First, as shown in FIG. 1, a player who is to play a violin 1000 generally needs to master the basic position. With the basic position, the player needs to put a tailpiece of the violin 1000 on her left shoulder 1002, sandwich the tailpiece of the violin between her left shoulder 1002 and jaw 1004, and grip a neck 1008 of the violin with her left hand 1006. Thus, a player should grip the neck 1008 with her left hand 1006 and adjust the pitch of sound by pressing a string (for example, string 1010) with her left finger 1016 while holding the tailpiece of the violin between her left shoulder 1002 and jaw 1004 as described above. Therefore, it is generally very difficult to maintain the basic position in a stable manner.

Furthermore, when a player plays the violin 1000 as shown in FIG. 1, her left hand 1006 grips the neck 1008 of the violin 1000 while greatly bending back and twisting. Thus, a joint of her left hand 1006 nearly reaches a limit of its range of motion. Therefore, it is no exaggeration to say that adult people whose joints have become stiff can hardly move their own left finger 1016 accurately, for example, from the string 1010 to another string 1011 in order to change the pitch of sound, except for people who have practiced the violin since their childhood.

Additionally, when a player plays the violin 1000, she needs to hold a bow 1012 with her right hand 1014 and rub a desired string with the bow 1012. As shown in FIG. 2, she needs to move the bow in a first direction 1022 when rubbing a low-pitched string of the violin 1000 (for example, string 1020) and move the bow in a second direction 1026 when rubbing a high-pitched string (for example, string 1024). Therefore, when a musical composition to be played includes both of pitches of the string 1020 and the string 1024, the player needs to move her right arm handling the bow over an angle of a degrees. Considerable skill is required to change pitches accurately by such movements in a state in which the aforementioned basic position is maintained. Thus, it will take a long time to acquire such skill.

As described above, it is difficult to master playing the violin. Particularly, it is very difficult for adult people to make progress even from an elementary stage. Therefore, there has been a problem that the number of violin players does not increase while the violin is a very popular musical instrument.

SUMMARY OF THE INVENTION

Problem(s) to be Solved by the Invention

The present invention has been made in view of the above drawbacks of the prior art. It is, therefore, an object of the present invention to provide a bowed string instrument that allows a player to hold it in a stable manner and to handle a bow and strings without much effect.

Means for Solving Problem(s)

According to a first aspect of the present invention, there is provided a bowed string instrument that allows a player to hold it in a stable manner and to handle a bow and strings without much effect. This bowed string instrument has a body, a shoulder pad connected to the body, a body receiver disposed below the body so as to receive a load of the body, and an operative joint portion coupling the body and the body receiver to each other while allowing the body to be slidable on a spherical surface. The body includes a fingerboard, a plurality of strings extending above the fingerboard, and a pair of bridges for supporting and tensioning the plurality of strings above the fingerboard.

Thus, the operative joint portion allows the body to be slidable on a spherical surface. Therefore, even when a player changes strings to be rubbed, she can maintain her arm that handles the bow (e.g., her right arm) at substantially the same angle. Furthermore, the player can stably hold the bowed string instrument with the body receiver even in a sitting position. Accordingly, the player can play the bowed string instrument more readily than the violin.

According to a second aspect of the present invention, there is provided a bowed string instrument that allows a player to hold it in a stable manner and to handle a bow and strings without much effect. This bowed string instrument includes a body, a shoulder pad connected to the body, a body receiver disposed below the body so as to receive a load of the body, and an operative joint portion coupling the body and the body receiver to each other while allowing the body to be rotatable about at least one axis with respect to the body receiver. The body includes a fingerboard, a plurality of strings extending above the fingerboard, and a pair of bridges for supporting and tensioning the plurality of strings above the fingerboard.

Thus, the operative joint portion allows the body to be rotatable about at least one axis with respect to the body receiver. Therefore, even when a player changes strings to be rubbed, she can maintain her arm that handles the bow (e.g., her right arm) at substantially the same angle. Furthermore, the player can stably hold the bowed string instrument with the body receiver even in a sitting position. Accordingly, the player can play the bowed string instrument more readily than the violin.

The operative joint portion may couple the body and the body receiver to each other while it allows the body to be rotatable on a curved surface. When the body is rotatable on a curved surface, a range in which the body can be rotated with respect to the body receiver can be extended.

Furthermore, the operative joint portion may couple the body and the body receiver to each other with a magnetic force. This configuration facilitates attachment and detachment of the body and the body receiver. In this case, the operative joint portion may include a projection provided on one of the body and the body receiver and a projection receiver for receiving the projection. The projection receiver is provided on the other of the body and the body receiver. One of the projection and the projection receiver may comprise a magnet, and the other of the projection and the projection receiver may comprise a magnetic material. Alternatively, the operative joint portion may be configured to couple the body and the body receiver to each other by engagement of the projection and the projection receiver.

Furthermore, a liner may be provided on at least one of the projection and the projection receiver and located between the projection and the projection receiver. This configuration can reduce noise generated when the body moves along the spherical surface of the projection.

The bowed string instrument may further have a separating portion extending on an opposite side of the fingerboard to the plurality of strings in a spaced relationship with the fingerboard and at least two joint portions coupling the body and the separating portion to each other. With this configuration, a ring structure is formed in the body. This ring structure allows tensile forces generated by tensioned strings to be dispersed. Accordingly, the body can be prevented from being warped by the tensile forces.

The body may further include at least one pitch guide portion located adjacent to one of the plurality of strings on the fingerboard for allowing a player to know pitches of sound to be produced. Such a pitch guide portion allows a player to visually grasp the location of a string to be pressed to produce a desired pitch of sound. In this case, the pitch guide portion may be configured so as not to be brought into contact with the adjacent string when the adjacent string is pressed. Furthermore, the pitch guide portion may be formed of a projection projecting from the fingerboard. Such a projection allows a player to grasp a location for a desired pitch not only visually, but also tactually.

The body receiver may include an abutment portion that can be brought into abutment against a player's thigh. Thus, the bowed string instrument can be fixed on a player's thigh even though the sitting player's thigh has a curved surface. Furthermore, the abutment portion may include at least two bar members. With this configuration, the body receiver can bring at least two bear members into contact with an object. Therefore, the bowed string instrument can be fixed on a player's thigh in a stable manner even though the sitting player's thigh has a curved surface. The abutment portion may include a contact portion that is brought into contact with at least three points of a player's thigh. Furthermore, the abutment portion may include a contact surface that is brought into surface contact with at least part of a player's thigh. Thus, the body receiver can be brought into surface contact with at least part of a sitting player's thigh. Therefore, the bowed string instrument can be fixed on a player's thigh in a stable manner even though the sitting player's thigh has a curved surface. The abutment portion may have lower end portions that are brought into contact with the same plane. In this case, the bowed string instrument can stably be placed on a flat surface such as a surface of a desk.

The body receiver may include a fixation portion that can be fixed to a player and a fixation connection portion connecting the fixation portion and the operative joint portion to each other. With this configuration, a player can play the bowed string instrument stably even in a standing position.

Advantageous Effects of the Invention

According to a bowed string instrument of the present invention, even when a player changes strings to be rubbed, she can maintain her arm that handles the bow (e.g., her right arm) at substantially the same angle. Furthermore, the player can stably hold the bowed string instrument with the body receiver even in a sitting position. Accordingly, the player can hold a bowed string instrument according to the present invention in a stable manner and can handle a bow and strings without much effect.

MODE(S) FOR CARRYING OUT THE INVENTION

Figure 1:
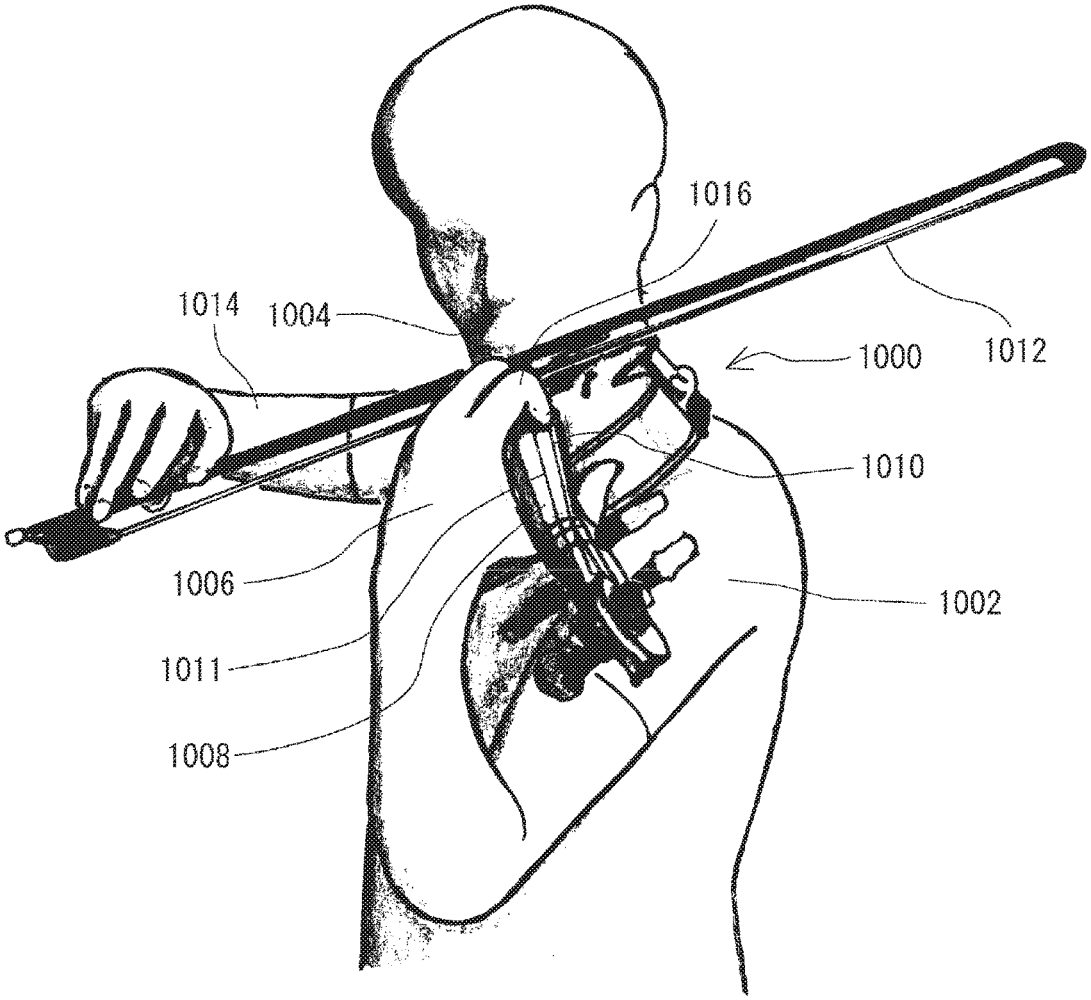
FIG. 1 is a schematic view showing a basic position for playing the violin.
Figure 2:
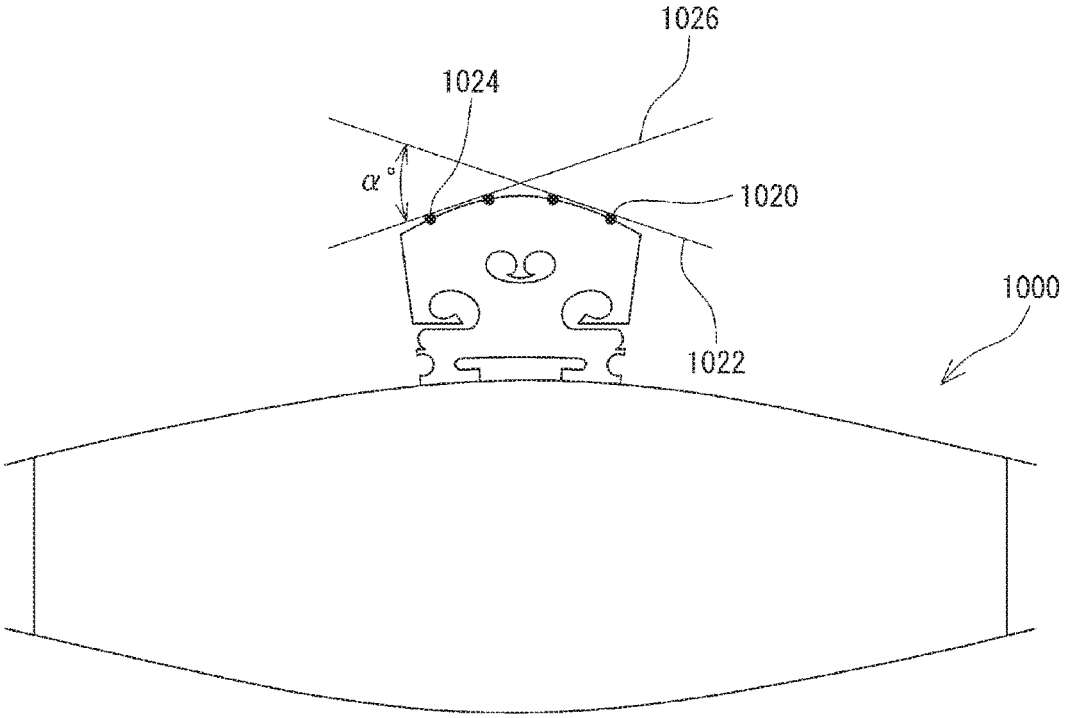
FIG. 2 is a schematic view explanatory of movement of a bow when a high-pitched string and a low-pitched string of the violin are rubbed respectively.

Embodiments of a bowed string instrument according to the present invention will be described in detail below with reference to FIGS. 3 to 28. In FIGS. 3 to 28, the same or corresponding parts are denoted by the same or corresponding reference numerals and will not be described below repetitively.

Figure 3:
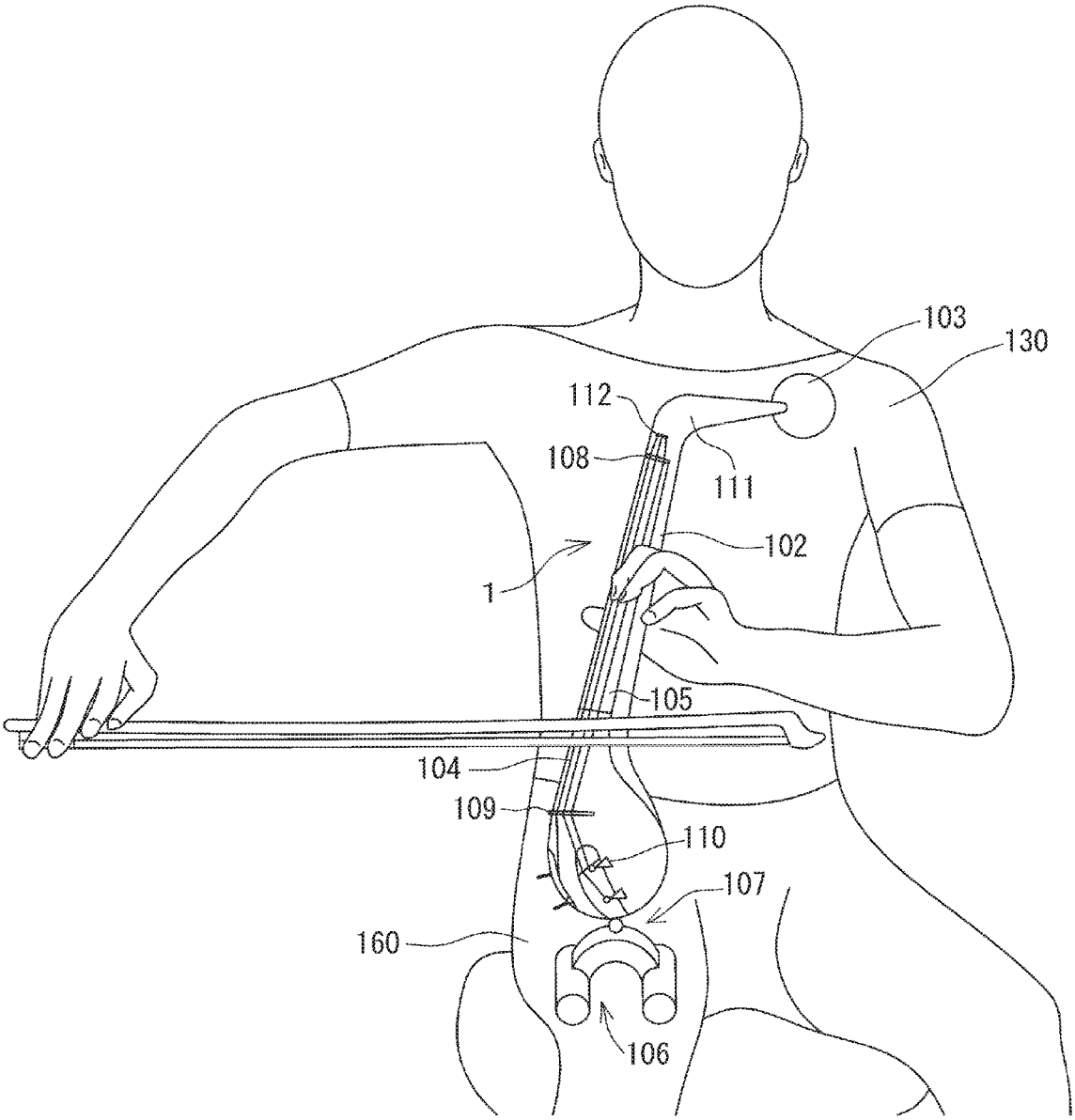
FIG. 3 is a schematic view showing a bowed string instrument according to a first embodiment
Figure 4:
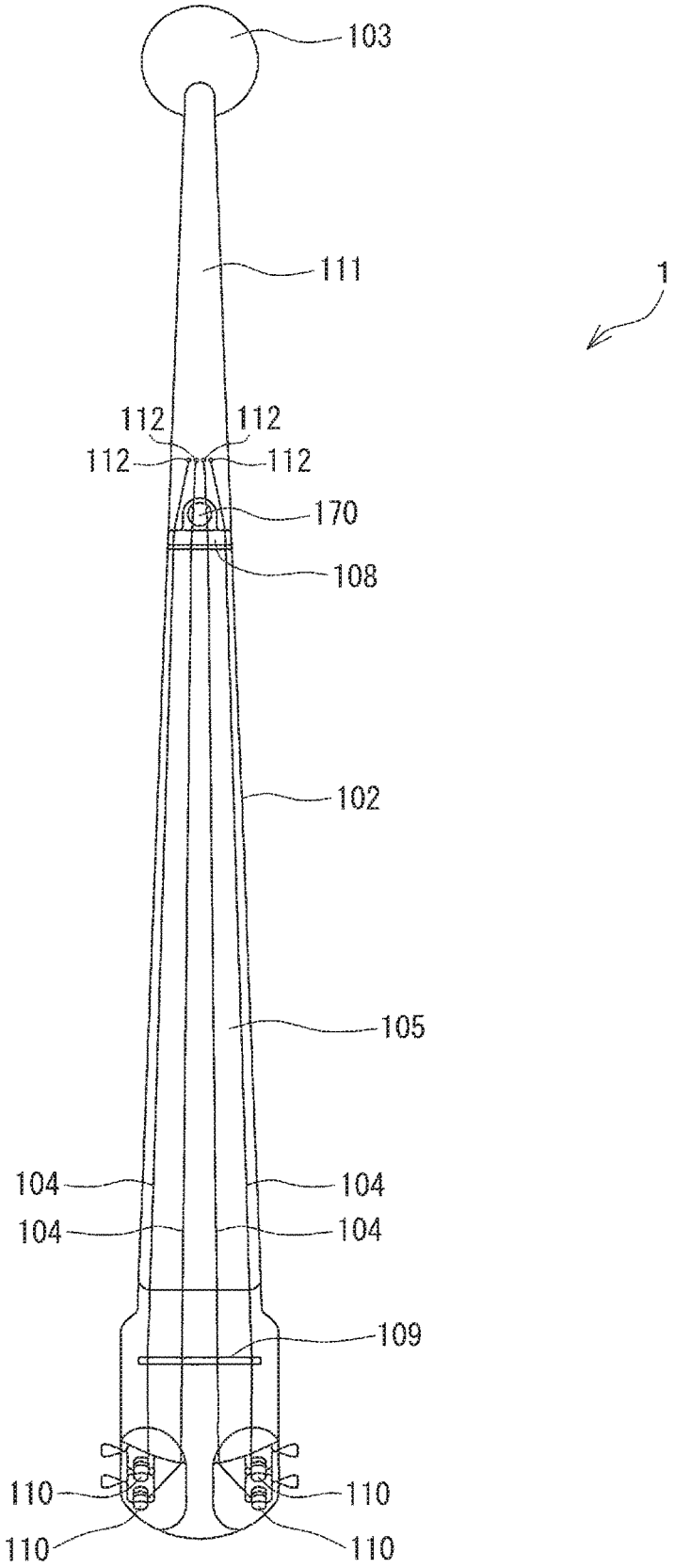
FIG. 4 is a front view of the bowed string instrument shown in FIG. 3.
Figure 5:
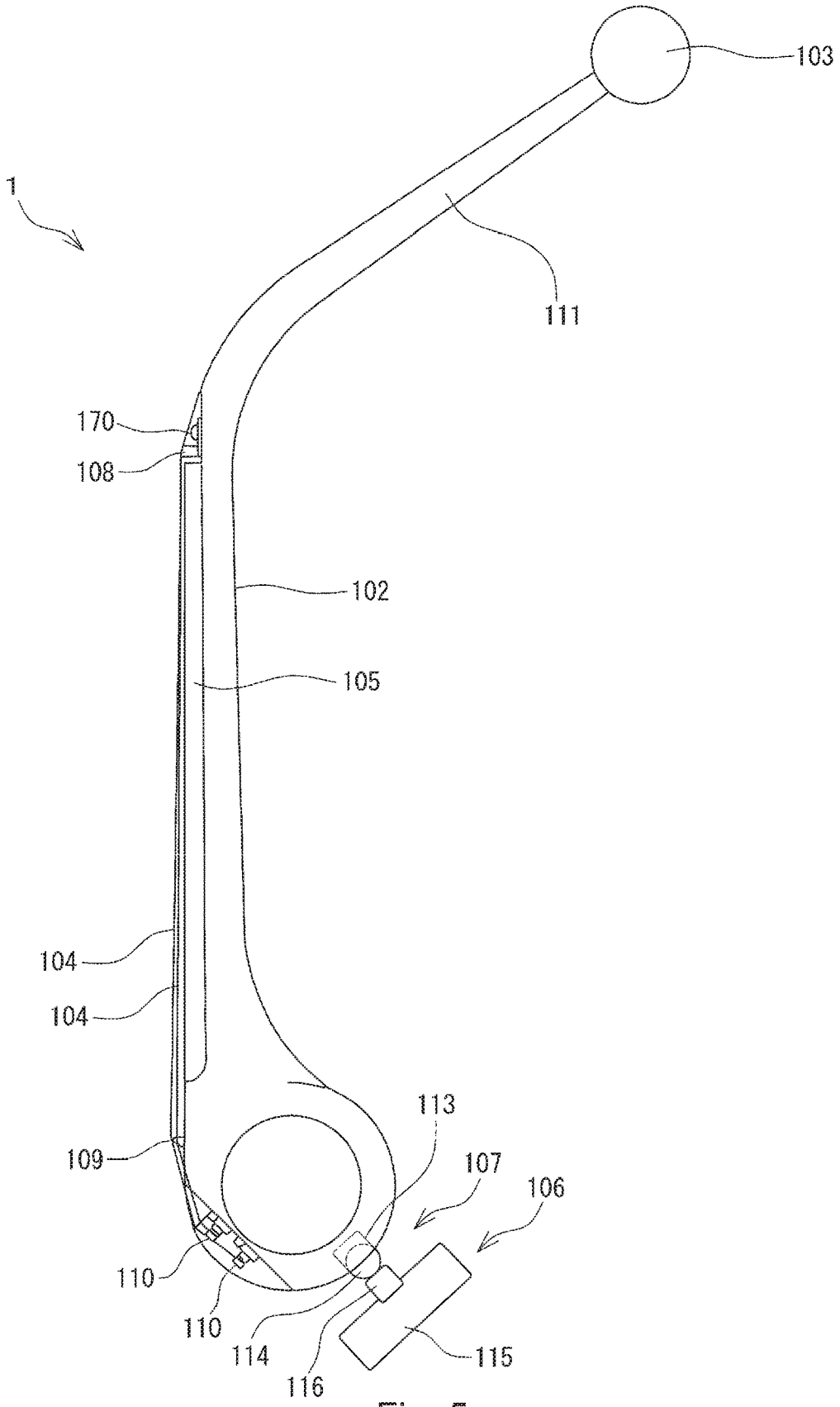
FIG. 5 is a right side view of the bowed string instrument shown in FIG. 4.
Figure 6:
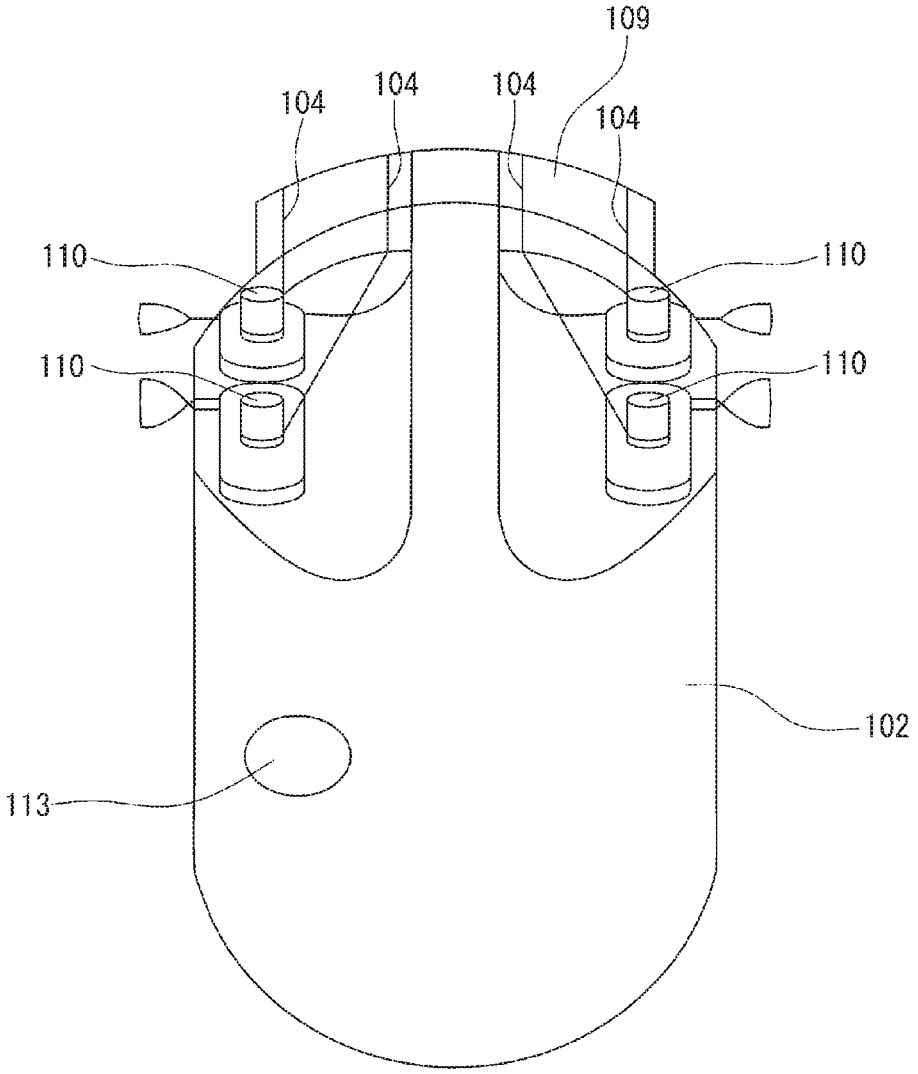
FIG. 6 is a bottom view of the bowed string instrument shown in FIG. 4.

FIG. 3 is a schematic view showing a bowed string instrument 1 according to a first embodiment of the present invention, FIG. 4 is a front view thereof, FIG. 5 is a right side view thereof, and FIG. 6 is a bottom view thereof. As shown in FIGS. 3 to 6, the bowed string instrument 1 of the present embodiment has a body 102, a shoulder pad 103 connected to an upper part of the body 102, a body receiver 106 disposed below the body 102 so as to receive a load of the body 102, and an operative joint portion 107 connecting the body 102 and the body receiver 106 to each other. The body receiver 106 and the operative joint portion 107 are not shown in FIG. 4 or 6.

As shown in FIGS. 3 to 6, the body 102 has a fingerboard 105, a plurality of strings 104 extending above the fingerboard 105, an upper bridge 108 and a lower bridge 109 as a pair of bridges for supporting and tensioning the strings 104 above the fingerboard 105, and a curved portion 111 provided on an upper side of the fingerboard 105 of the body 102. In FIG. 6, the curved portion 111 and the shoulder pad 103 are omitted from the illustration.

As shown in FIG. 4, each of the strings 104 is inserted into a string insertion hole 112 located on an upper side of the upper bridge 108. A ball end (not shown) provided on an end of each of the strings 104 is engaged with the string insertion hole 112 so that each of the strings 104 is fixed into the string insertion hole 112. Another end of each of the strings 104 is wound around a peg 110 provided on a lower side of the lower bridge 109. In this embodiment, as described above, the ends of the strings 104 are wound around the pegs 110 so that the strings 104 are fixed. Therefore, a player can change the tension of each of the stretched strings 104 by adjusting the degree to which the end of each of the strings 104 is wound around the peg 110. Thus, the player can adjust the pitch of sound to be produced when the string 104 is rubbed. According to the present embodiment, the upper bridge 108 is configured to be movable in a longitudinal direction of the fingerboard 105. The upper bridge 108 is moved to a desired position and then fixed to the body 102 with a bolt 170.

As shown in FIGS. 3 to 5, the shoulder pad 103 is provided at a tip of the curved portion 111, which is provided on the upper side of the fingerboard 105 of the body 102. Therefore, a player can bring the shoulder pad 103 into contact with her shoulder portion 130 (see FIG. 3) to take the most comfortable position for playing the instrument by adjusting the degree to which the curved portion 111 is curved or the length of the curved portion 111.

Figure 7:
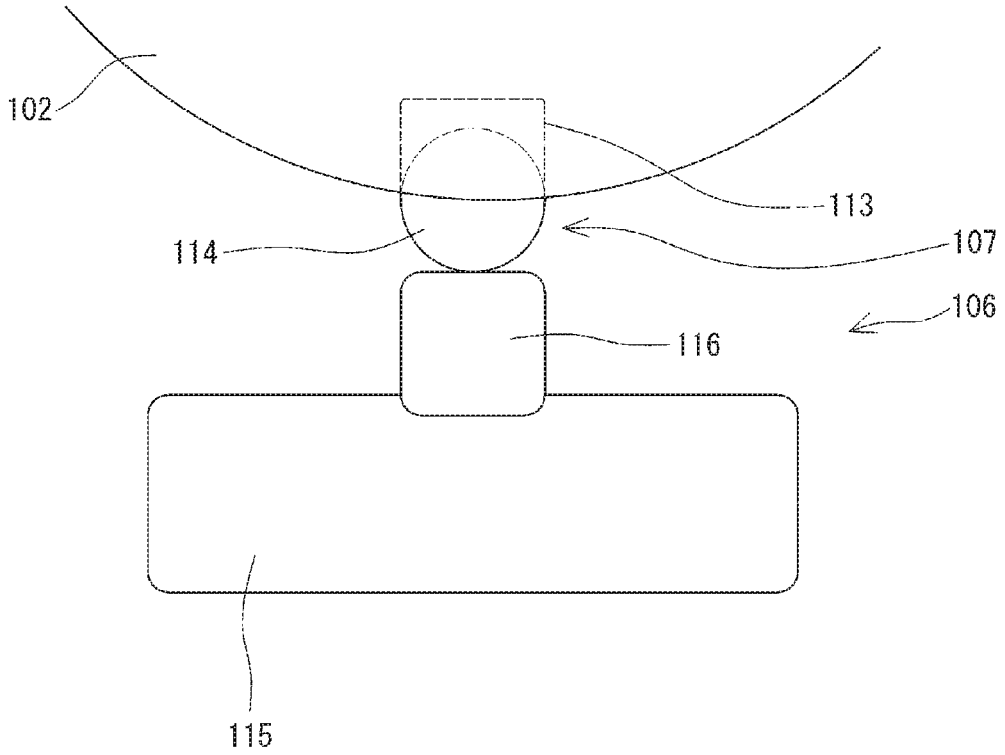
FIG. 7 is an enlarged view showing the vicinity of an operative joint portion of the bowed string instrument shown in FIG. 5.
Figure 8:
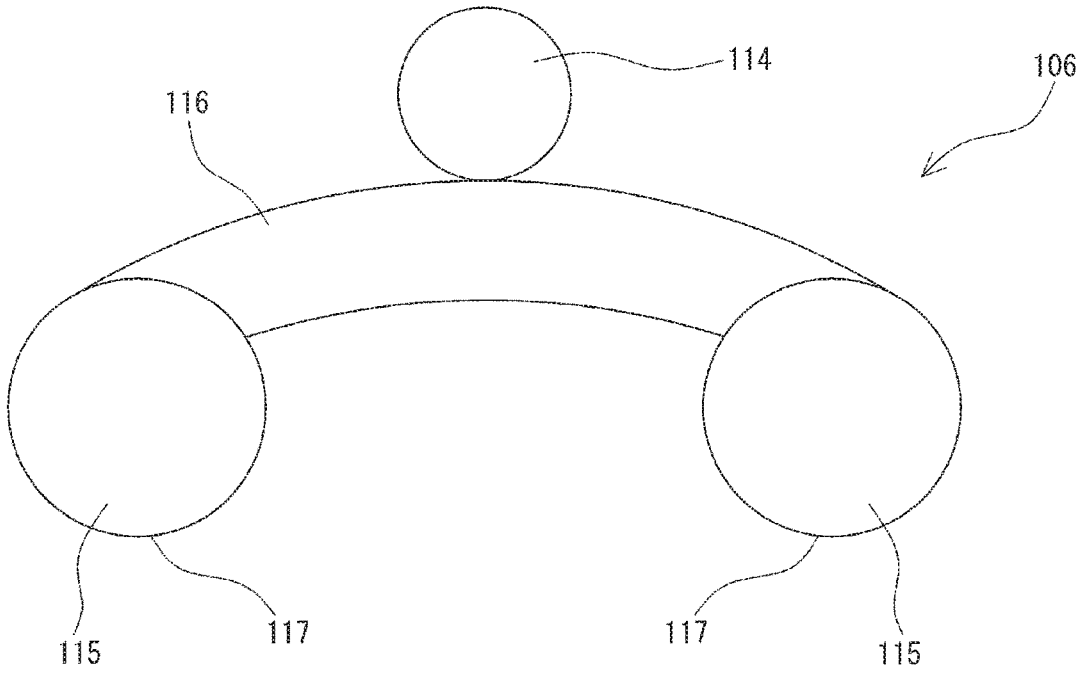
FIG. 8 is a front view showing a body receiver and a projection of the operative joint portion in the first embodiment of the present invention.

FIG. 7 is an enlarged schematic view showing the vicinity of the operative joint portion 107. As shown in FIG. 7, the operative joint portion 107 of this embodiment includes a projection 114 provided at an upper portion of the body receiver 106 and a projection receiver 113 provided at a bottom of the body 102. FIG. 8 is a front view showing the body receiver 106 and the projection 114 of the operation joint portion 107, FIG. 9 is a side view thereof, and FIG. 10 is a plan view thereof.

Figure 9:
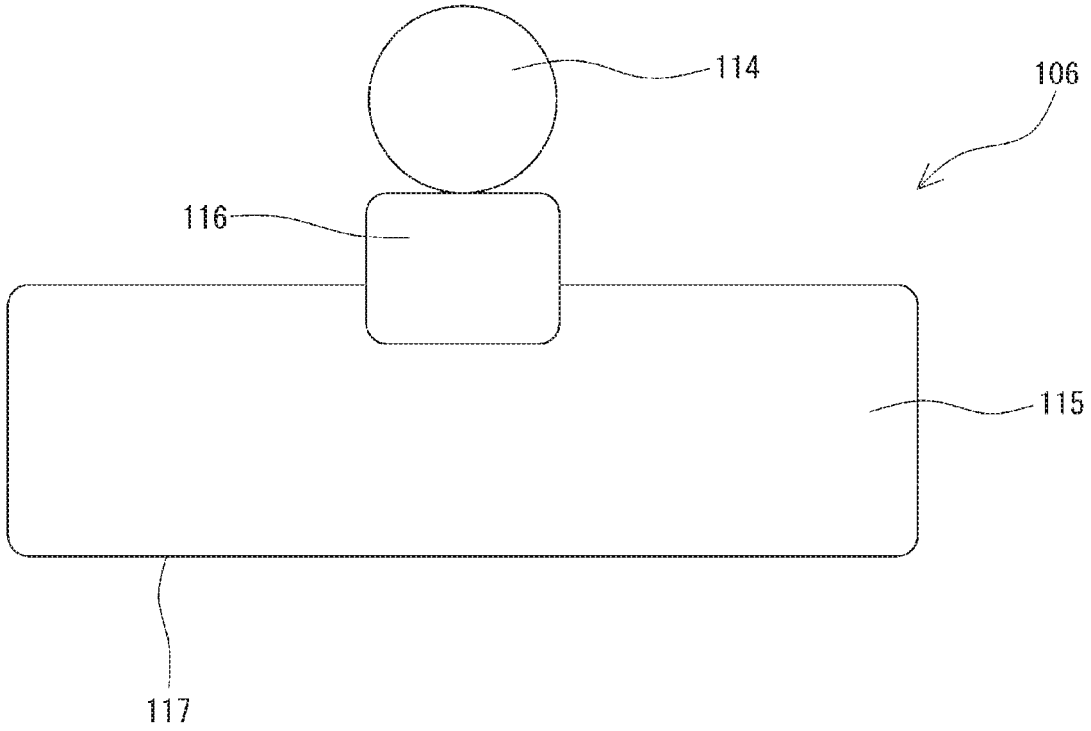
FIG. 9 is a side view of the body receiver and the projection shown in FIG. 8.
Figure 10:
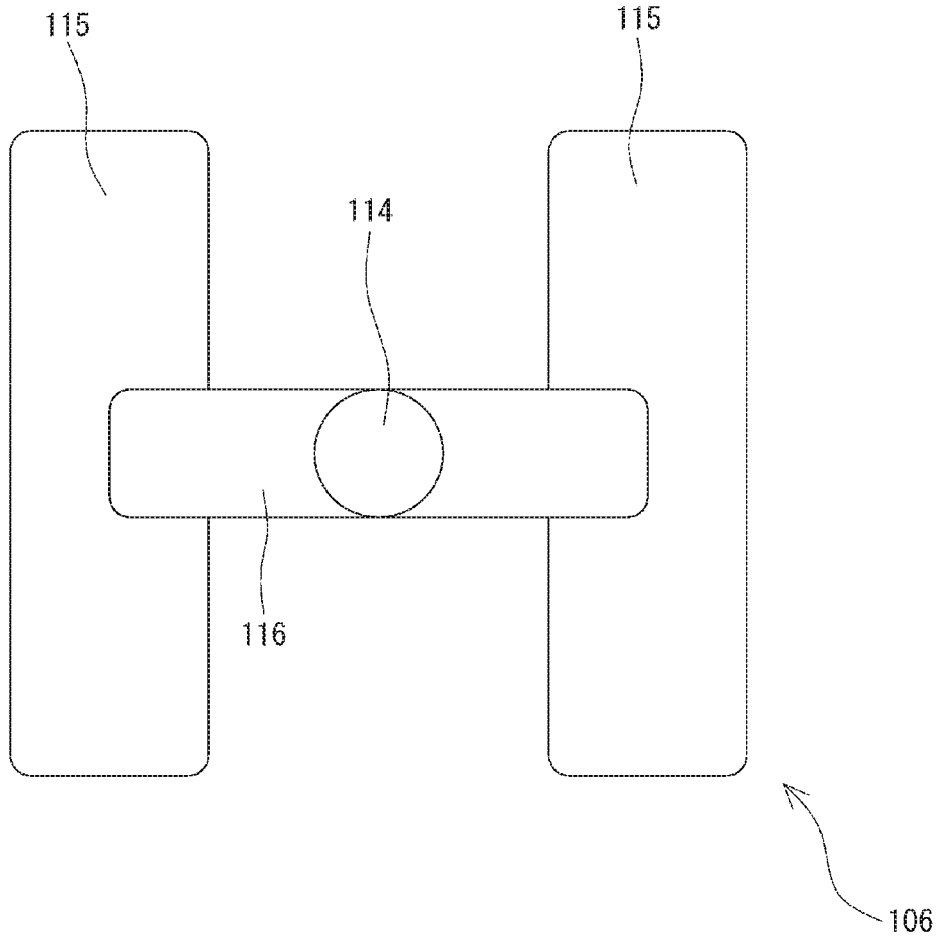
FIG. 10 is a plan view of the body receiver and the projection shown in FIG. 8.

As shown in FIGS. 8 to 10, the body receiver 106 of this embodiment has abutment portions 115 formed of two bar members and a bridge portion 116 bridging between intermediate portions of the two abutment portions 115 in a longitudinal direction of the abutment portions 115. The bridge portion 116 is curved so as to be convex upward. Both ends of the bridge portion 116 are respectively connected to the two abutment portions 115, which are directed in the same direction. With this configuration, when the body receiver 106 is brought into abutment against a sitting player's thigh 160 such that the direction along which the sitting player's thigh 160 extends is aligned with the longitudinal direction of the abutment portions 115 as shown in FIG. 3, the bowed string instrument 1 can be fixed on the player's thigh 160 even though the sitting player's thigh 160 has a curved surface.

Furthermore, the abutment portions 115 are configured so that bottoms 117 of the two abutment portions 115 are on the same plane. Therefore, the bowed string instrument 1 can stably be placed on a flat surface such as a surface of a desk.

Figure 11:
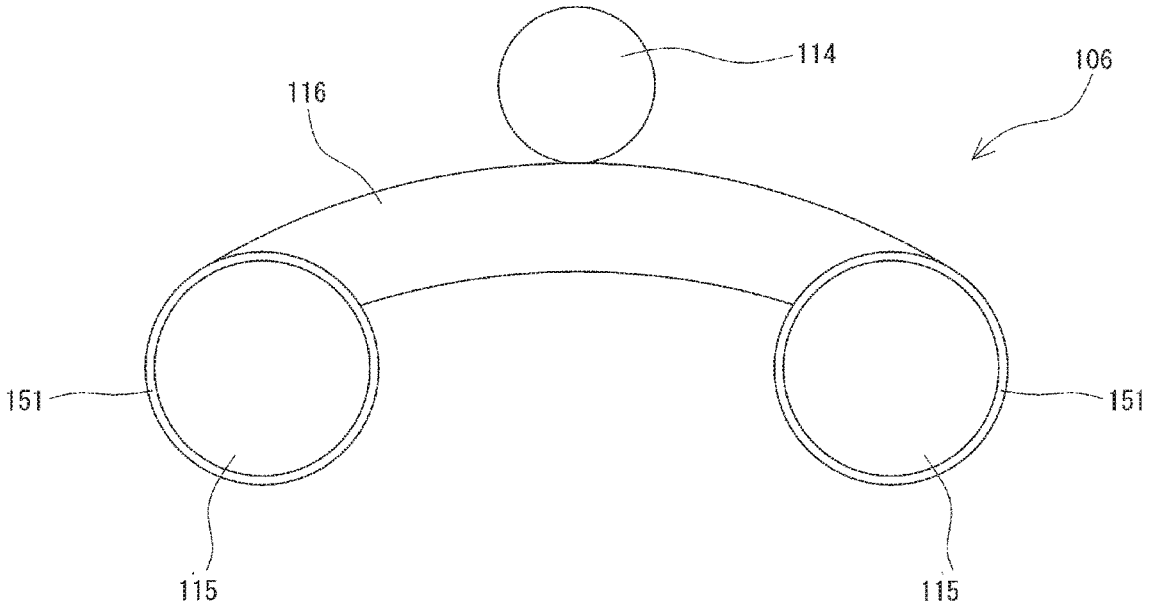
FIG. 11 is a front view showing a variation of the body receiver illustrated in FIG. 8.

As shown in FIG. 11, an elastic member 151, such as sponge, may be attached onto an outer circumferential surface of each of the abutment portions 115. When such elastic members 151 are attached onto the outer circumferential surfaces of the abutment portions 115, those elastic members 151 serve as cushions for holding and pressing the player's thigh 160 therebetween. Therefore, the bowed string instrument can more stably be fixed onto the player's thigh 160.

As shown in FIG. 8, the projection 114 of the operative joint portion 107 is arranged at the center of a top portion of the bridge portion 116 of the body receiver 106. For example, the projection 114 is formed of an iron ball as a magnetic material. The projection receiver 113 (see FIGS. 6 and 7), which corresponds to the projection 114, is formed of a magnet having a hemispherical surface corresponding to a spherical surface of the projection 114. With this configuration, the body 102 and the body receiver 106 are detachably coupled to each other by magnetic forces generated between the magnet of the projection receiver 113 and the iron ball of the projection 114.

Furthermore, as shown in FIG. 7, the spherical surface of the projection 114 and the hemispherical surface of the projection receiver 113 are brought into sliding contact with each other while they are coupled to each other by magnetic forces. Accordingly, the body 102 can freely move at any angles on the spherical surface of the projection 114 while it is coupled to the body receiver 106.

Materials used for the projection 114 are not limited to iron. Any magnetic material may be used for the projection 114. Particularly, it is preferable to use a ferromagnetic material for the projection 114. For example, cobalt, nickel, gadolinium, and the like may be used as a ferromagnetic material other than iron.

Figure 12:
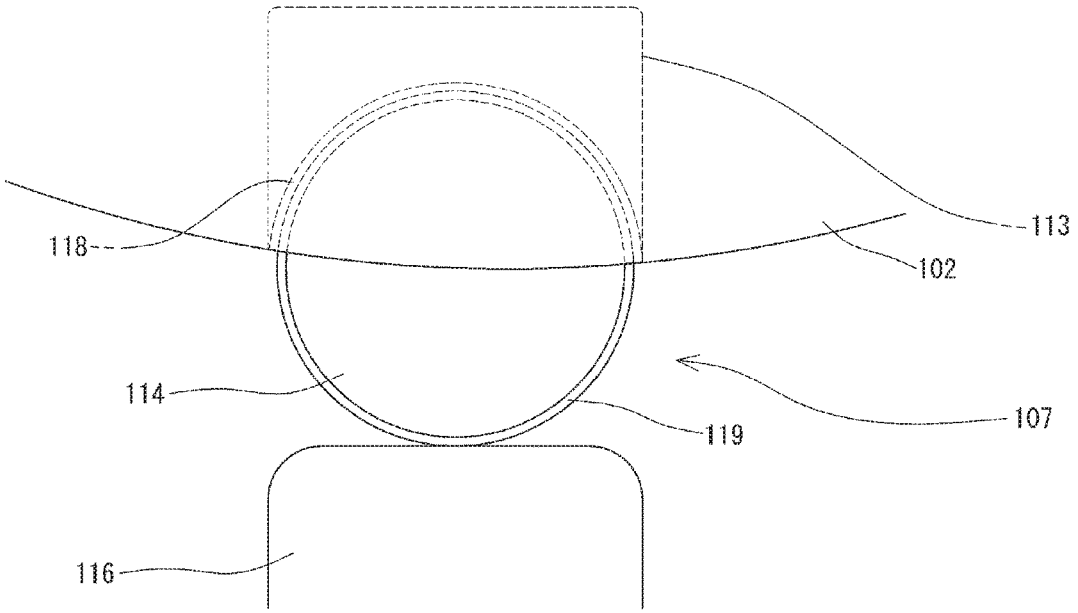
FIG. 12 is an enlarged view showing a variation of the operative joint portion shown in FIG. 7.

Furthermore, as shown in FIG. 12, a liner 118 may be provided on the projection receiver 113 of the operative joint portion 107 so as to cover the hemispherical surface of the projection receiver 113. A liner 119 may be provided on the projection 114 of the operative joint portion 107 so as to cover the spherical surface of the projection 114. When those liners 118 and 119 are interposed between the projection receiver 113 and the projection 114, the operative joint portion 107 performs smooth movement. Therefore, noise can be reduced when the body 102 moves on the spherical surface of the projection 114. For example, such liners 118 and 119 may be formed of plastic such as polyethylene or ceramic having a smooth outer surface. Such a liner may be provided on either one of the projection receiver 113 and the projection 114.

Figure 13:
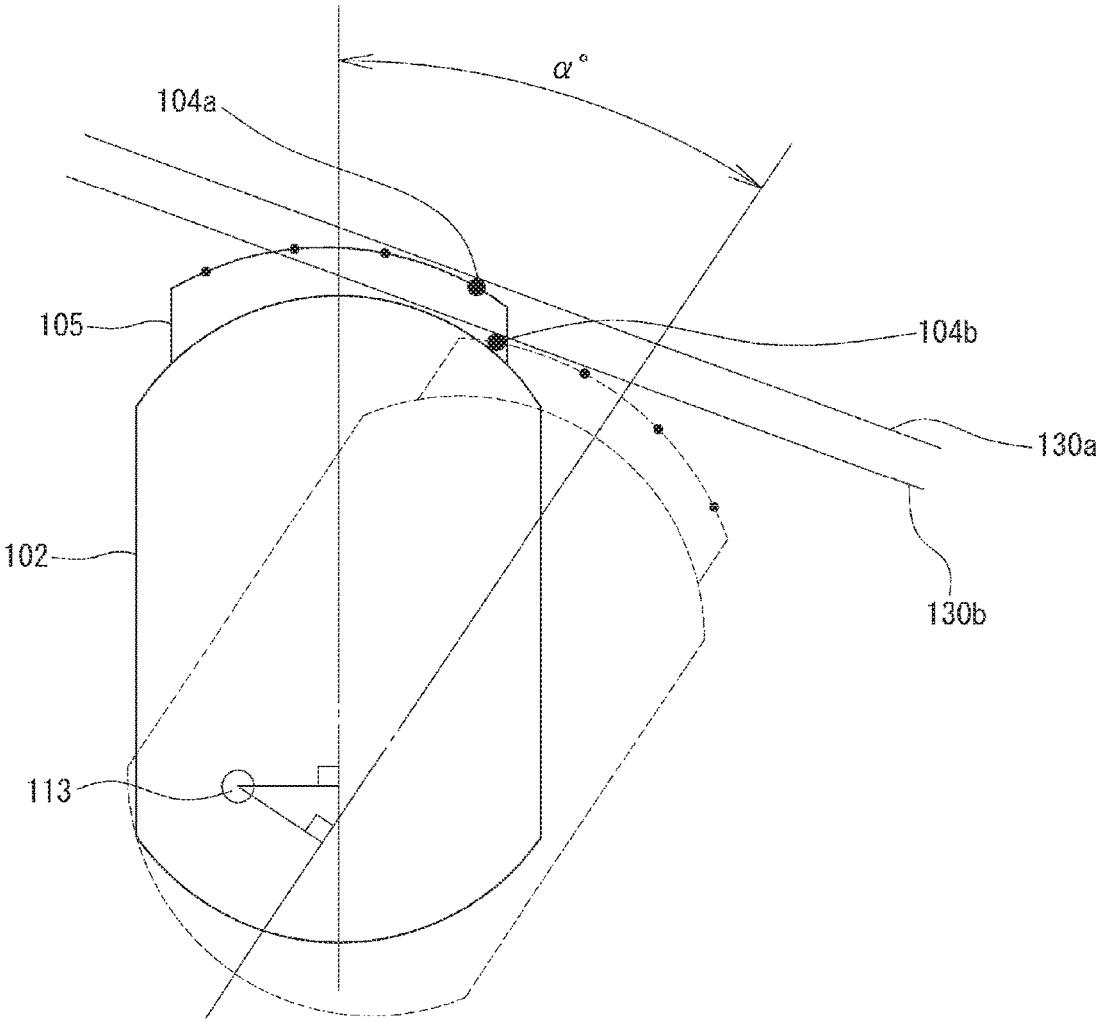
FIG. 13 is a schematic view explanatory of a sliding state of the body when the bowed string instrument shown in FIG. 3 is being played.

FIG. 13 is a schematic view explanatory of a sliding movement of the body 102 when the bowed string instrument 1 is played. In FIG. 13, the solid lines represent the position of the body 102 when a high-pitched string 104*a* is rubbed by a bow, and the dashed lines represent the position of the body 102 when a low-pitched string 104*b* is rubbed by a bow. As described above, the operative joint portion 107 allows the body 102 to be slidable with respect to the body receiver 106. Therefore, for example, when the string rubbed by the bow is changed from the high-pitched string 104*a* to the low-pitched string 104*b*, the body 102 is slid at α° about the vertical axis as illustrated in FIG. 13. At that time, a direction 130*a* in which the bow is moved to rub the high-pitched string 104*a* (hereinafter referred to as a string rubbing direction) is the same as a string rubbing direction 130*b* in which the bow is moved to rub the low-pitched string 104*b*. Accordingly, a player of the bowed string instrument 1 can maintain her arm that moves the bow (e.g., her right arm) at substantially the same angle by swinging the body 102 through α° about the vertical axis even if she rubs any of the strings 104 with the bow. Furthermore, as shown in FIG. 3, she can stably hold the bowed string instrument 1 with the body receiver 106 even in a sitting position. Thus, a player can slide or rotate the body 102 of the bowed string instrument 1 to handle the bow and the strings without much effort. Accordingly, the player can play the bowed string instrument 1 more readily than the violin.

In the present embodiment, as shown in FIG. 10, the body receiver 106 has one bridge portion 116. Nevertheless, the body receiver 106 may have two or more bridge portions 116. Furthermore, in the present embodiment, the body receiver 106 has two abutment portions 115. Nevertheless, the body receiver 106 may have three or more abutment portions 115. In the present embodiment, the two abutment portions 115 extend in parallel to each other. Nevertheless, the abutment portions 115 may not extend in parallel to each other.

Furthermore, in the present embodiment, the operative joint portion 107 includes the projection 114 formed of a magnetic material (e.g., iron) and the projection receiver 113 formed of a magnet. Nevertheless, the operative joint portion 107 may include the projection 114 formed of a magnet and the projection receiver 113 formed of a magnetic material (e.g., iron).

Moreover, the form of the projection 114 of the operative joint portion 107 is not limited to a sphere. Correspondingly, the projection receiver 113 is not limited to the form having a hemispherical surface. In other words, each of the projection 114 and the projection receiver 113 may have any shape as long as the body 102 and the body receiver 106 are coupled to each other in a slidable manner. For example, the projection 114 may be a sphere, and the projection receiver 113 may be in the form of a pipe having an end that can be brought into contact with a surface of the sphere of the projection 114. In the present embodiment, the body 102 is allowed to freely move at any angles on the spherical surface of the projection 114 by sliding contact between the spherical surface of the projection 114 and the hemispherical surface of the projection receiver 113. The shapes of the projection 114 and the projection receiver 113 may be changed such that the body 102 rotates about at least one axis. In such a case, a player can stably hold the bowed string instrument 1 and play the bowed string instrument 1 more readily than the violin.

Furthermore, in the present embodiment, the body receiver 106 is provided with the projection 114, and the body 102 is provided with the projection receiver 113. Nevertheless, the body 102 may be provided with the projection 114, and the body receiver 106 may be provided with the projection receiver 113. Moreover, the projection 114 or the projection receiver 113 may not necessarily be provided if the body 102 is coupled to the body receiver 106 in a slidable manner or a rotatable manner.

Figure 14:
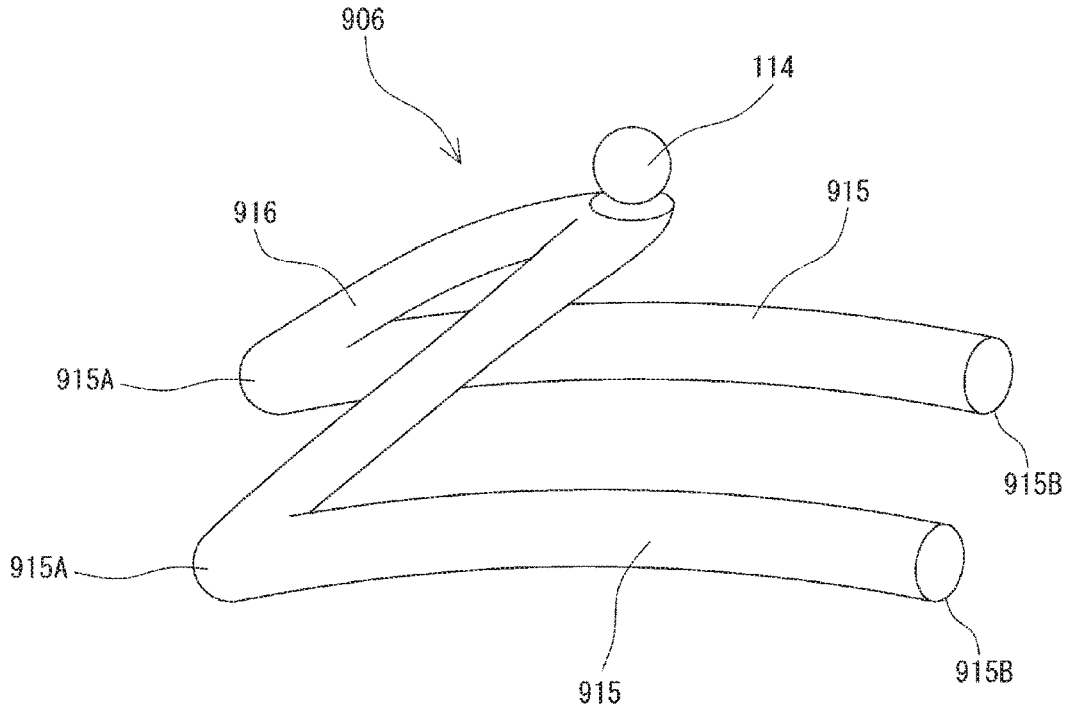
FIG. 14 is a perspective view showing a variation of the body receiver illustrated in FIG. 8.
Figure 15:
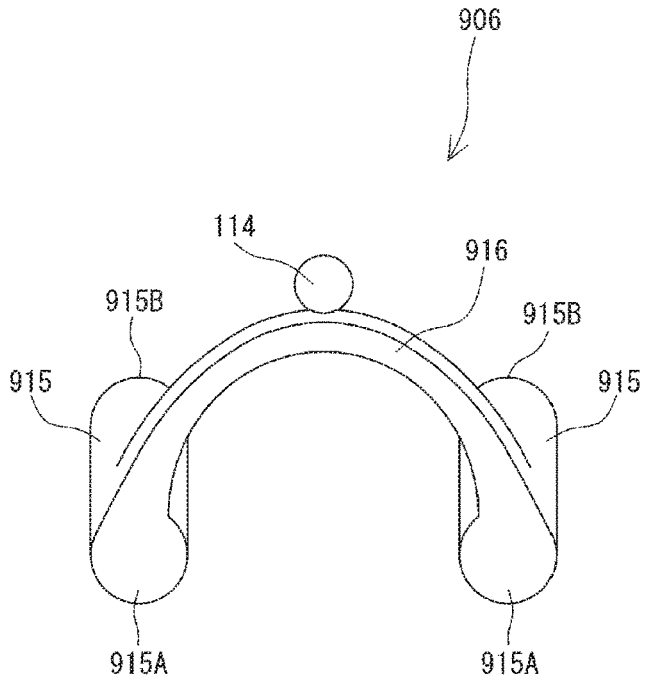
FIG. 15 is a front view of the body receiver and a projection shown in FIG. 14.

FIG. 14 is a perspective view showing a variation of the aforementioned body receiver 106, and FIG. 15 is a front view thereof. As shown in FIGS. 14 and 15, a body receiver 906 of this variation has two abutment portions 915, each of which has end portions 915A and 915B, and a bridge portion 916 bridging between the end portions 915A. Each of the abutment portions 915 is curved upward. The bridge portion 916 is substantially in the form of a U-shape that is inclined toward the middles of the abutment portions 915 along a longitudinal direction of the abutment portions 915. A projection 114 is provided at the center of a top portion of the bridge portion 916.

Furthermore, as shown in FIG. 15, the body receiver 906 has a structure that is symmetrical with respect to the center of the projection 114. Additionally, the projection 114 is located between the two abutment portions 915 and above the vicinity of the middles of the abutment portions 915 along the longitudinal direction of the abutment portions 915.

As described above, each of the abutment portions 915 is curved upward. Therefore, the abutment portions 915 of the body receiver 906 are brought into contact with at least four points (contact portions) of a player's thigh, which include the two end portions 915A and the two end portions 915B. Accordingly, the body receiver 906 can stably be fixed onto the player's thigh. In this example, the abutment portions 915 are brought into contact with at least four points of the player's thigh that include the two end portions 915A and the two end portions 915B. Nevertheless, the present invention is not limited to this example. As long as the body receiver 906 has at least three points serving as contact portions, the body receiver 906 can stably be fixed onto a player's thigh with a plane defined by those three points.

Furthermore, a belt-like member may be wound around the vicinity of the middles of the two abutment portions 915 along the longitudinal direction of the abutment portions 915 to fix the body receiver 906 onto a player's thigh. With such a belt-like member, the body receiver 906 can be fixed onto the player's thigh more stably. Such a belt-like member may be used for the body receiver 106 of the first embodiment.

Figure 16:
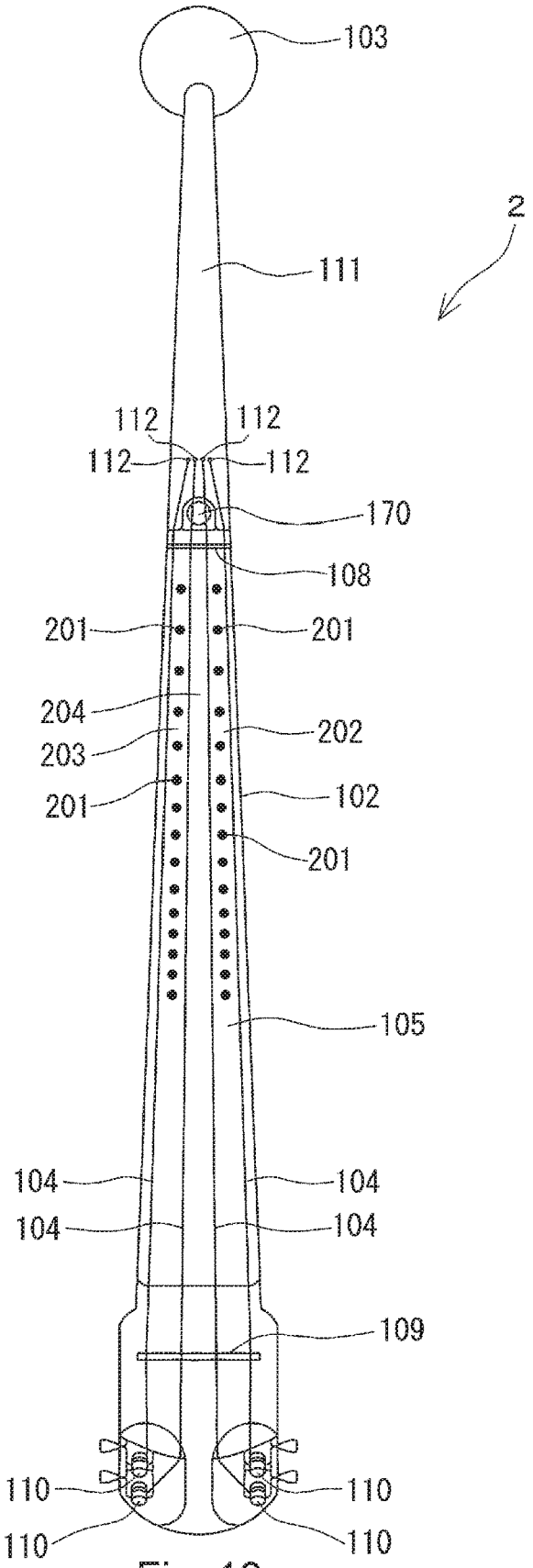
FIG. 16 is a front view showing a body and a shoulder pad of a bowed string instrument according to a second embodiment of the present invention.

FIG. 16 is a front view showing a body 102 and a shoulder pad 103 of the bowed string instrument 2 according to a second embodiment of the present invention. As shown in FIG. 16, four strings 104 are tensioned above a fingerboard 105 of the body 102. Thus, three inter-string portions (a first inter-string portion 202, a second inter-string portion 203, and a third inter-string portion 204) are formed between the strings 104. In the present embodiment, a plurality of pitch guide portions 201 are formed in each of the first inter-string portion 202 and the second inter-string portion 203 on the fingerboard 105 for allowing a player to know pitches of sound to be produced. Furthermore, a pitch guide portion 201 formed in the first inter-string portion 202 and a corresponding pitch guide portion 201 formed in the second inter-string portion 203 are arranged at substantially the same distance from the upper bridge 108. For example, the pitch guide portions 201 are formed at intervals at which the pitch changes by a semitone.

In this manner, since the pitch guide portions 201 are provided adjacent to the strings 104, a player can visually grasp the location of a portion of a string to be pressed to produce a desired pitch of sound. In the present embodiment, as shown in FIG. 16, the pitch guide portions 201 are formed within the inter-string portions. Therefore, when a player presses a string, the pitch guide portions 201 are not brought into contact with the string. Accordingly, characteristics of fretless musical instruments such as a violin can be utilized to generate musical sound. Furthermore, as shown in FIG. 16, the pitch guide portions 201 are formed within the two inter-string portions including the first inter-string portion 202 and the second inter-string portion 203 in this embodiment. Therefore, locations for desired pitches can be grasped more readily as compared to a case where pitch guide portions 201 are formed within one inter-string portion only.

Figure 17:
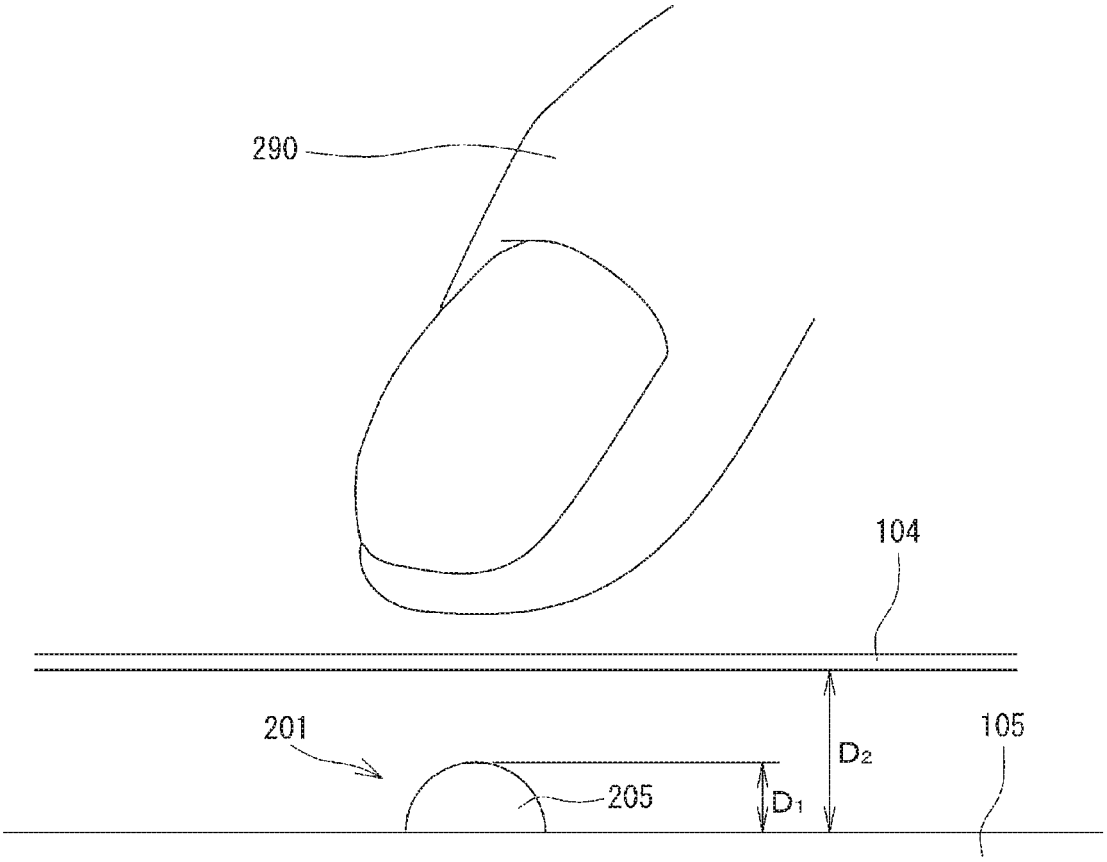
FIG. 17 is a schematic view showing a pitch guide portion of the bowed string instrument illustrated in FIG. 16.

Furthermore, as shown in FIG. 17, a projection 205 may be formed on the fingerboard 105, for example, with a nail to form a pitch guide portion 201. In this case, a player can grasp the locations for desired pitches not only visually, but also tactually, by touching the projections 205 with her finger 290. At that time, as shown in FIG. 17, the height $D_1$ from the fingerboard 105 to the top of the projection 205 is quite smaller than the height $D_2$ from the fingerboard 105 to the string 104. Therefore, when a player presses the string 104, the string 104 is not brought into contact with the pitch guide portion 201, unlike a fret and a string of a guitar, for example. Accordingly, characteristics of fretless musical instruments such as a violin can be utilized to generate musical sound.

In the present embodiment, the pitch guide portions 201 are formed only within the first inter-string portion 202 and the second inter-string portion 203. Pitch guide portions 201 may further be formed within the third inter-string portion 204 to facilitate visual recognition of locations for desired pitches or for design purposes. Alternatively, pitch guide portions 201 may be formed only within either one of the inter-string portions. As a matter of course, the number of inter-string portions in which pitch guide portions 201 may be formed varies depending upon the number of strings being tensioned.

For example, a rubber member or the like may be adhered to the fingerboard 105 to form a projection 205 of a pitch guide portion 201. For visual recognition of locations for desired pitches, the pitch guide portions 201 may be formed without the projections 205 by markings at desired locations on the fingerboard 105.

Figure 18:
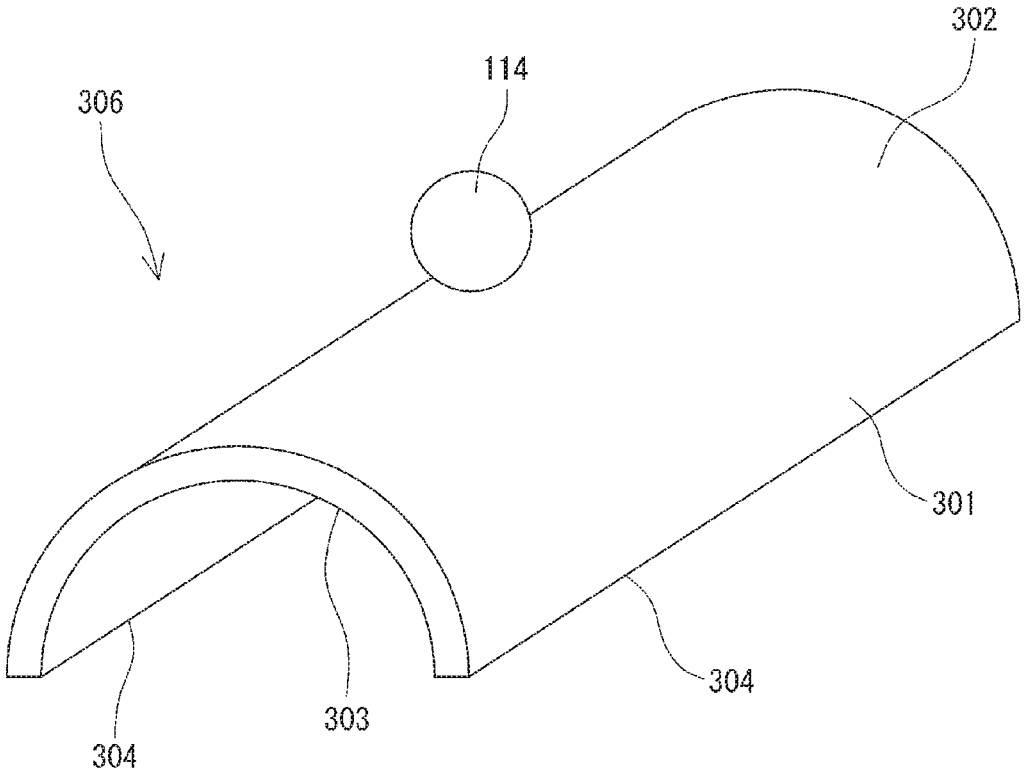
FIG. 18 is a perspective view showing a body receiver and a projection of an operative joint portion according to a third embodiment of the present invention.

FIG. 18 is a perspective view showing a body receiver 306 and a projection 114 according to a third embodiment of the present invention. The body receiver 306 of this embodiment includes an abutment portion 301 in the form of an arched bridge. This abutment portion 301 has a curved front surface 302 and a curved rear surface 303, which are curved so as to project upward. Those curved front surface 302 and curved rear surface 303 extend along one direction so that the abutment portion 301 is in the form of a tunnel. The projection 114 of the operative joint portion 107 is disposed at the center of a top portion of the curved front surface 302. The curved rear surface 303 has two lower end portions 304, which are configured so that the lower end portions 304 can be brought into contact with the same plane.

In the present embodiment, the curved rear surface 303 of the body receiver 306 has a curved shape corresponding to a sitting player's thigh. Thus, the body receiver 306 can be brought into surface contact with the sitting player's thigh. In other words, the curved rear surface 303 serves as a contact surface that is brought into surface contact with at least part of a player's thigh. Since such a contact surface is formed on the abutment portion 301, the bowed string instrument 1 can be fixed onto a sitting player's thigh. Furthermore, since the two lower end portions 304 of the curved rear surface 303 are formed so as to be in contact with the same plane, the bowed string instrument can stably be placed on a flat surface such as a surface of a desk. The projection 114 may be provided at a location other than the center of the top portion of the curved front surface 302. In the present embodiment, the abutment portion 301 of the body receiver 306 is in the form of a tunnel. Nevertheless, the abutment portion 301 may have any shape as long as it is configured to be brought into surface contact with at least part of a player's thigh.

Figure 19:
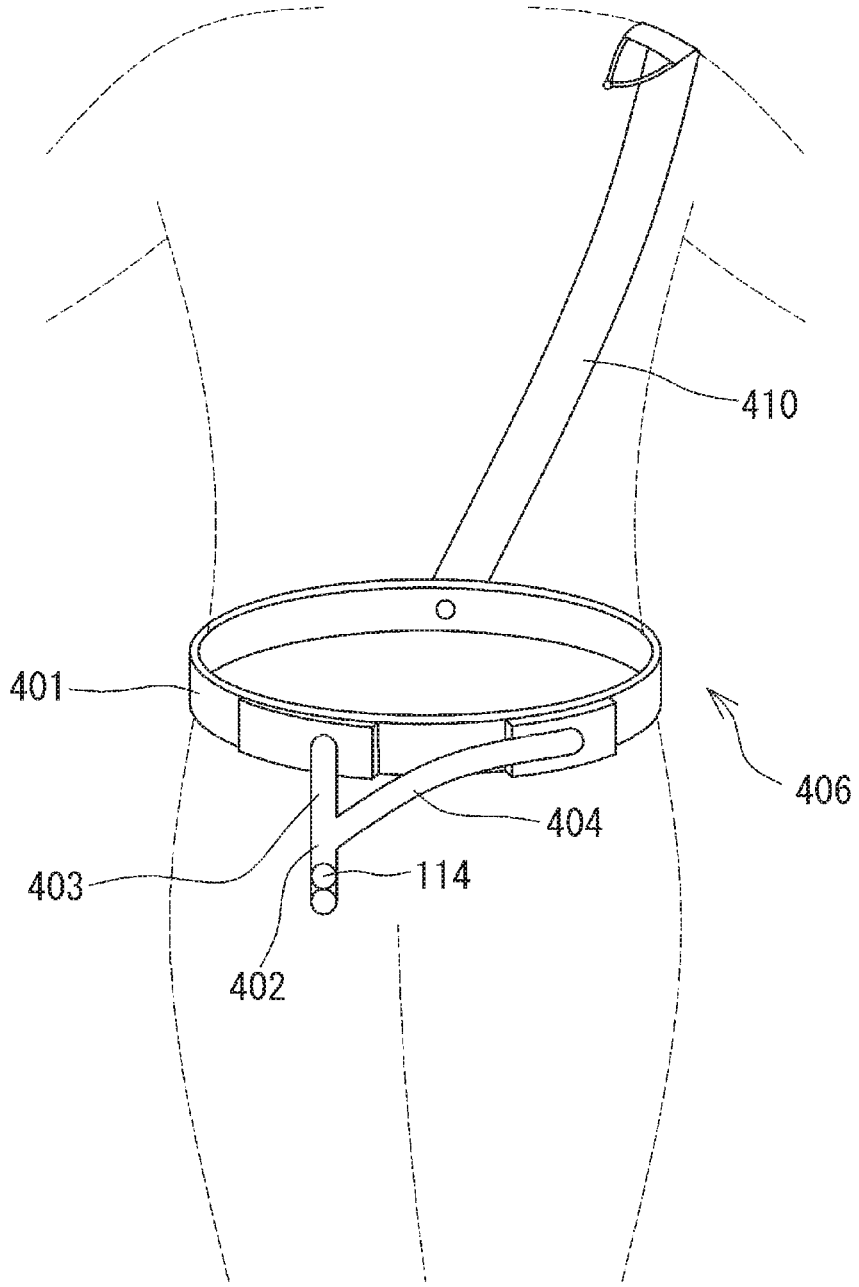
FIG. 19 is a perspective view showing a body receiver and a projection of an operative joint portion according to a fourth embodiment of the present invention.
Figure 20:
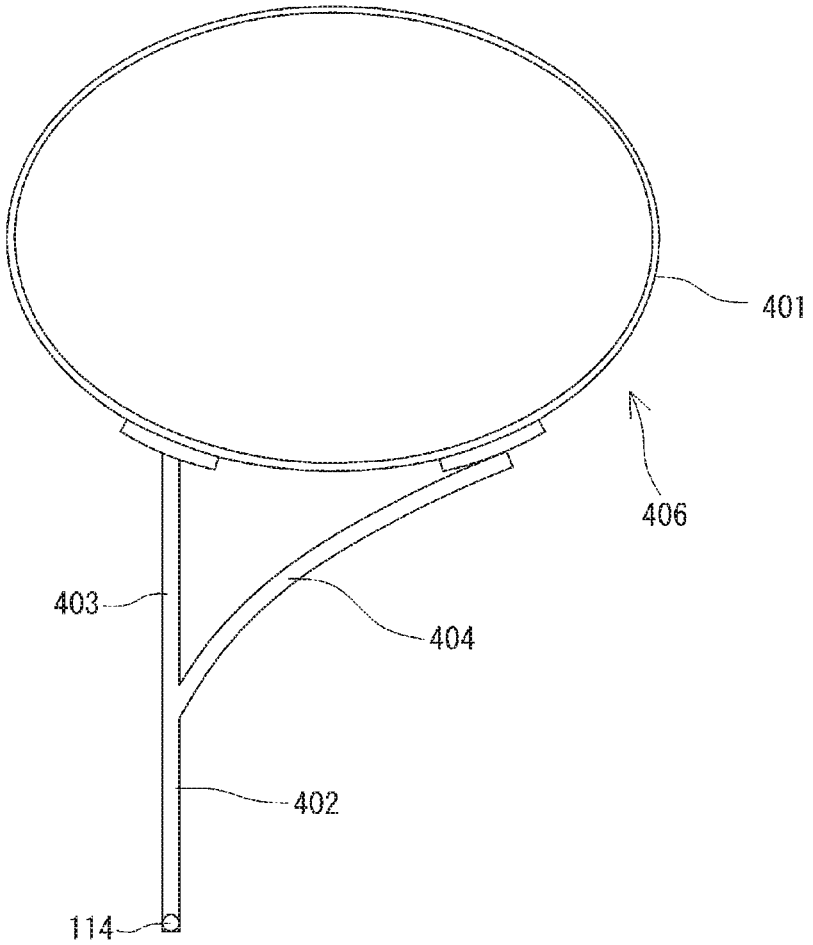
FIG. 20 is a plan view of the body receiver and the projection shown in FIG. 19.
Figure 21:
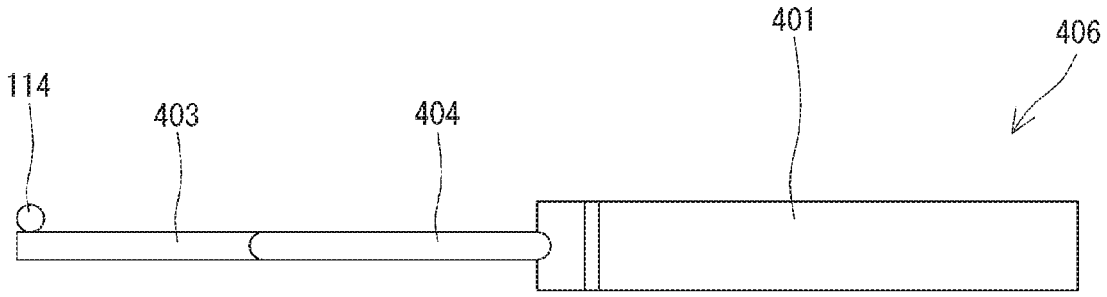
FIG. 21 is a right side view of the body receiver and the projection shown in FIG. 19.

FIG. 19 is a perspective view showing a body receiver 406 and a projection 114 according to a fourth embodiment of the present invention, FIG. 20 is a plan view thereof, and FIG. 21 is a right side view thereof. As shown in FIGS. 19 to 21, the body receiver 406 of this embodiment includes a belt-like fixation portion 401, which can be fixed to a player, and a fixation connection portion 402 connecting the fixation portion 401 and the projection 114 of the operative joint portion to each other.

As shown in FIGS. 19 to 21, the fixation connection portion 402 has a branched structure such that the connection portion 402 can be connected to the fixation portion 401 at two points located in front of a player. With this branched structure, the fixation connection portion 402 includes a first connection portion 403 linearly connecting the projection 114 and the fixation portion 401 to each other and a second connection portion 404 branched roughly in the middle of the first connection portion 403 along a longitudinal direction of the first connection portion 403 and connected to the fixation portion 401.

Figure 22:
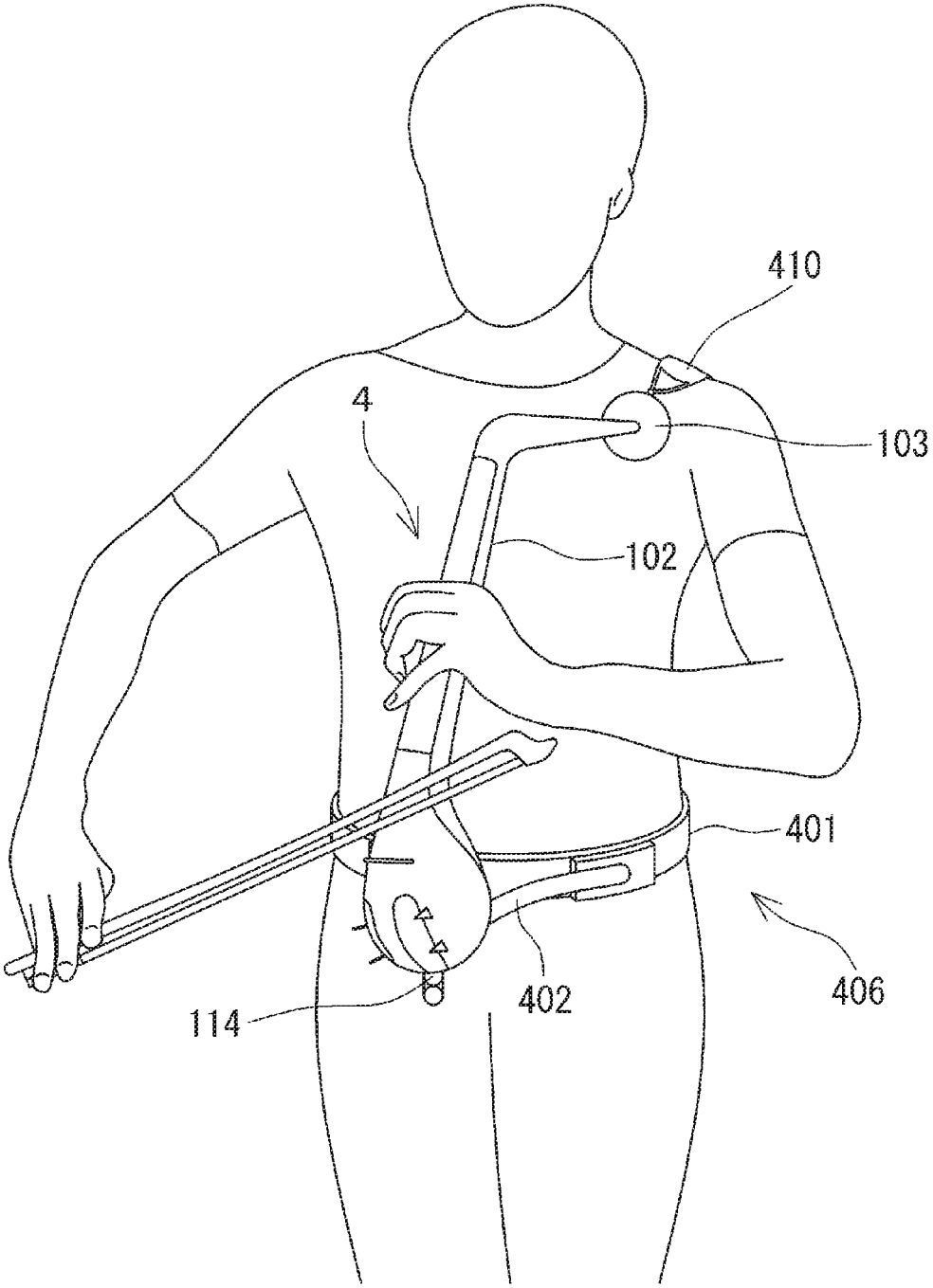
FIG. 22 is a schematic view showing that the bowed string instrument according to the fourth embodiment is played.

Thus, the fixation portion 401 and the projection 114 are connected by the fixation connection portion 402. Therefore, when the body receiver 406 is mounted with a player so that a direction in which the first connection portion 403 of the fixation connection portion 402 extends is perpendicular to a player's standing direction, a bottom of the body 102 can be supported by the body receiver 406 even if the player is in a standing position. Accordingly, as shown in FIG. 22, an upper portion of the body 102 may further be supported by the shoulder pad 103 so that the player can play the bowed string instrument 4 stably even in a standing position.

Furthermore, in the present embodiment, two connection portions including the first connection portion 403 and the second connection portion 404 are respectively connected to the fixation portion 401. Therefore, the body receiver 406 of this embodiment can support the body 102 more stably as compared to a case where one connection portion is connected to the fixation portion 401.

Moreover, in the present embodiment, a strap 410 (not shown in FIG. 20 or 21) is attached to an opposite side to the side on which the fixation connection portion 402 of the fixation portion 401 is provided. As shown in FIG. 22, the strap 410 can be connected to the shoulder pad 103. The bowed string instrument 4 can be held more stably for playing when the strap 410 is connected to the shoulder pad 103.

In the present embodiment, the fixation connection portion 402 has one branched structure connected to two portions of the fixation portion 401. Nevertheless, the number of portions connected to the fixation portion 401 is not limited to two. For example, another branched structure may be formed to provide a third connection portion so that the fixation connection portion 402 is connected to three portions of the fixation portion 401. The fixation connection portion 402 may be connected to four or more portions of the fixation portion 401.

Furthermore, in the present embodiment, the fixation connection portion 402 is jointed to the fixation portion 401. Nevertheless, the fixation connection portion 402 may be connected to the fixation portion 401 by magnetic forces. Specifically, a magnet may be mounted onto one of the fixation portion 401 and the fixation connection portion 402, and a magnetic material such as iron may be mounted to the other of the fixation portion 401 and the fixation connection portion 402. Thus, the fixation connection portion 402 and the fixation portion 401 can be connected to each other by magnetic forces.

Furthermore, the body receiver 406 of this embodiment includes a belt-like fixation portion 401. The fixation portion may be configured to attachable to a belt that is passed through loops on player's trousers. For example, the fixation portion may be formed by a hook member that can be engaged with a belt that is passed through loops on player's trousers.

Figure 23:
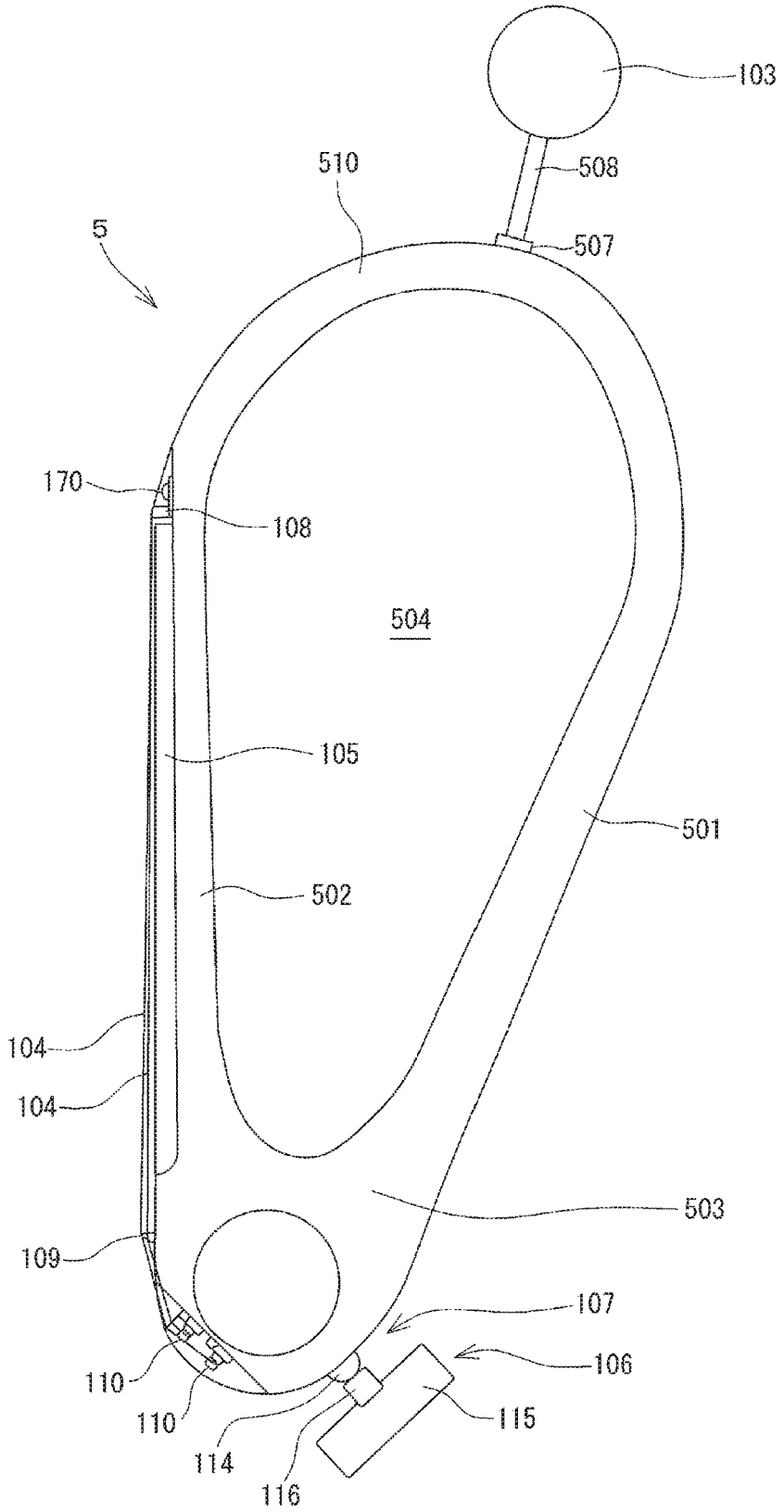
FIG. 23 is a side view showing a bowed string instrument according to a fifth embodiment of the present invention.

FIG. 23 is a side view showing a bowed string instrument 5 according to a fifth embodiment of the present invention. As shown in FIG. 23, the bowed string instrument 5 of this embodiment has a body 502, a separating portion 501 extending on an opposite side of the fingerboard 105 to the strings 104 in a spaced relationship with the fingerboard 105, and a first joint portion 510 and a second joint portion 503 connecting the body 502 and the separating portion 501 to each other.

With this configuration, the separating portion 501, the first joint portion 510, the body 502 opposed to the separating portion, and the second joint portion 503 form an opening portion 504. This opening portion 504 produces a ring structure of the body 502, which allows tensile forces generated by the tensioned strings 104 to be dispersed to the separating portion 501 via the first joint portion 510 and the second joint portion 503. Therefore, the body 502 can be prevented from being warped by the tensile forces. In order to enhance the rigidity to the tensile forces, it is preferable to form the body 502, the separating portion 501, the first joint portion 510, and the second joint portion 503 integrally with each other.

Furthermore, as shown in FIG. 23, a collet 507 is attached to the first joint portion 510. A rod 508 extends from the shoulder pad 103. The rod 508 is held by the collet 507 so that the shoulder pad 103 is connected to the body 502. In the present embodiment, the collet 507 is used to connect the shoulder pad 103 to the body 502. Nevertheless, other connection members (e.g., a bolt, a screw, and a nut) may be used to connect the shoulder pad 103 to the body 502. Furthermore, in the above first embodiment, the shoulder pad 103 may be connected to the body 102 with a connection member such as the collet 507 of the present embodiment.

In the present embodiment, an opening portion 504 having a substantially elliptical shape is formed between the separating portion 501 and the body 502. However, the separating portion 501 and the joint portions 510 and 503 may be configured to form an opening portion having a triangular shape or a semicircular shape. The number of the joint portions is not limited to two. Three or more joint portions may be provided.

Figure 24:
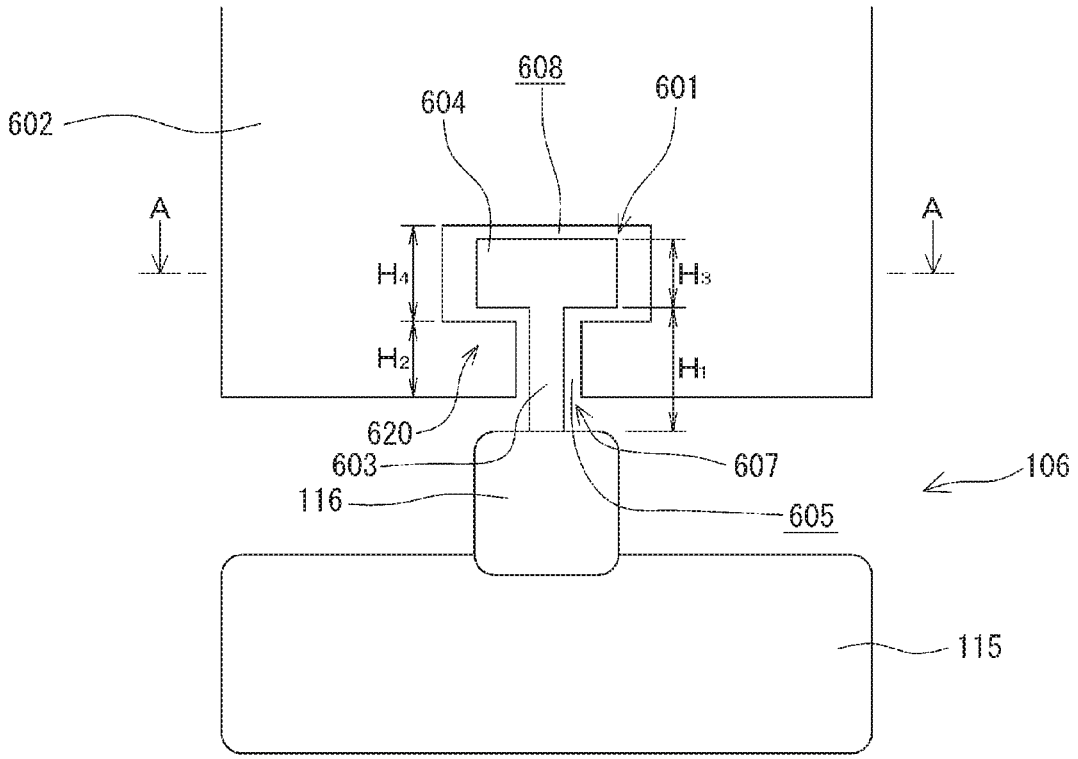
FIG. 24 is a vertical cross-sectional view showing an operative joint portion according to a sixth embodiment of the present invention.
Figure 25:
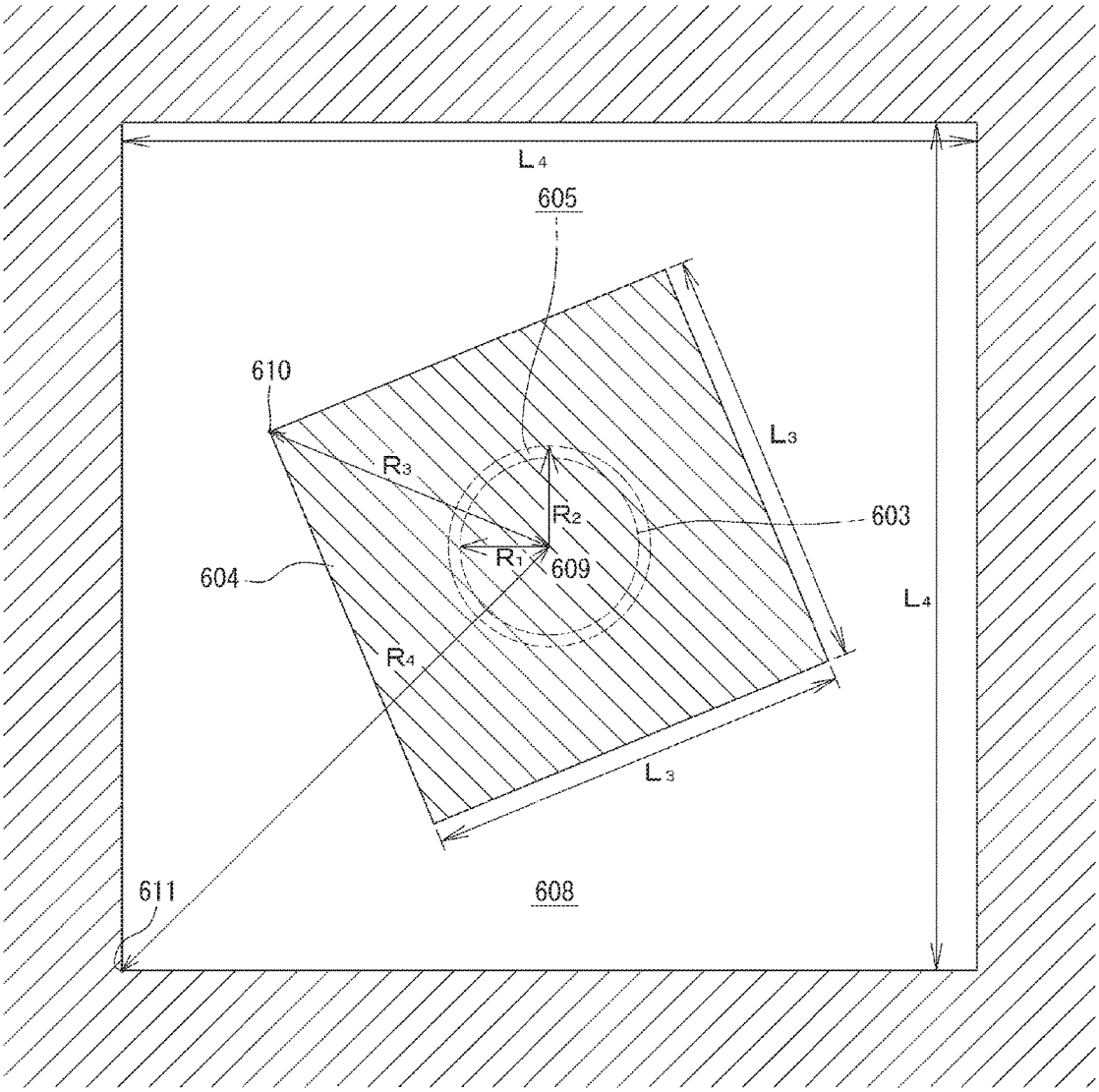
FIG. 25 is a cross-sectional view taken along line A-A of FIG. 24.

FIG. 24 is a vertical cross-sectional view schematically showing an operative joint portion 607 according to a sixth embodiment of the present invention. FIG. 25 is a cross-sectional view taken along line A-A of FIG. 24. As shown in FIG. 24, the operative joint portion 607 of the present embodiment includes a projection 601 disposed at the center of a top portion of the bridge portion 116 of the body receiver 106 according to the first embodiment and a projection receiver 620 formed on a bottom of a body 602.

As shown in FIGS. 24 and 25, the projection 601 includes an insertion portion 603 having a cylindrical shape extending upward from the bridge portion 116 of the body receiver 106 and an engagement portion 604 formed above the insertion portion 603. As shown in FIG. 25, the insertion portion 603 has a perfect circular cross-section on a plane perpendicular to the vertical direction. Furthermore, the engagement portion 604 has a square cross-section on the plane perpendicular to the vertical direction. As shown in FIG. 24, the projection receiver 620 includes an insertion hole 605 formed in the bottom of the body 602 and a receiver 608 located above the insertion hole 605 and formed within the body 602. As shown in FIG. 25, the insertion hole 605 has a perfect circular cross-section on the plane perpendicular to the vertical direction. The receiver 608 has a square cross-section on the plane perpendicular to the vertical direction. FIGS. 24 and 25 show that the insertion portion 603, the insertion hole 605, the engagement portion 604, and the receiver 608 are disposed so as to have a common center 609.

As shown in FIG. 25, $L_4>L_3>R_2>R_1$ where $R_1$ is the radius of the cross-section of the insertion portion 603 on the plane perpendicular to the vertical direction, $R_2$ is the radius of the cross-section of the insertion hole 605 on the plane perpendicular to the vertical direction, $L_3$ is the length of one side of the cross-section of the engagement portion 604 on the plane perpendicular to the vertical direction, and $L_4$ is the length of one side of the cross-section of the receiver 608 on the plane perpendicular to the vertical direction. Furthermore, as shown in FIG. 24, $H_1>H_2$ where $H_1$ is the height of the insertion portion 603, and $H_2$ is the height of the insertion hole 605. Moreover, $H_4>H_3$ where $H_3$ is the height of the engagement portion 604, and $H_4$ is the height of the receiver 608. Therefore, as shown in FIG. 24, the projection 601 and the projection receiver 620 of the present embodiment can be engaged with each other while a certain gap is formed between the projection 601 and the projection receiver 620. As shown in FIG. 25, $R_4>R_3$ where $R_4$ is the length from the center 609 to one of corners 611 of the receiver 608, and $R_3$ is the length from the center 609 to one of corners 610 of the engagement portion 604. In the present embodiment, the operative joint portion 607 is configured such that $L_4>2\times R_3$ (see FIG. 25).

With the above configuration, the body 602 is coupled to the body receiver 106 by engagement of the engagement portion 604 of the projection 601 and the receiver 608 of the projection receiver 620. As described above, the insertion portion 603 has a cylindrical shape extending upward from the bridge portion 116 of the body receiver 106. A certain gap is formed between the projection 601 and the projection receiver 620. Therefore, a cylindrical surface of the insertion portion 603 of the projection 601 is brought into sliding contact with a cylindrical surface of the insertion hole 605 while the body 602 is coupled to the body receiver 106. Thus, in the present embodiment, the body 602 is rotatable about the insertion portion 603, which extends in the vertical direction, on an outer circumferential curved surface of the insertion portion 603 of the projection 601 while the body 602 is coupled to the body receiver 106.

Other arrangements can be used as long as the body 602 is coupled to the body receiver 606 by engagement of the projection 601 and the projection receiver 620 and can be rotated about one or more axes with respect to the body receiver 606. For example, the operative joint portion 607 may be configured such that the engagement portion 604 has a perfect circular cross-section on a plane perpendicular to the vertical direction and/or the receiver 608 has a perfect circular cross-section on a plane perpendicular to the vertical direction.

Figure 26:
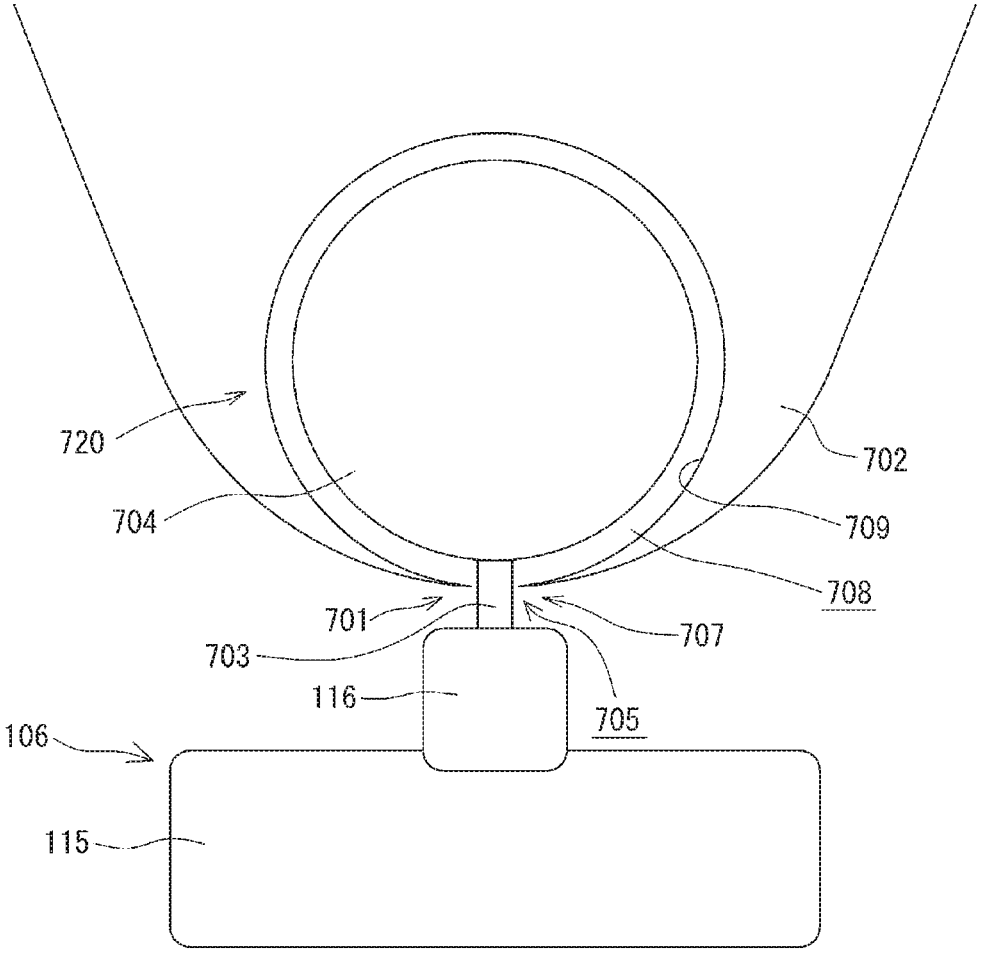
FIG. 26 is a vertical cross-sectional view showing an operative joint portion according to a seventh embodiment of the present invention.

FIG. 26 is a vertical cross-sectional view schematically showing an operative joint portion 707 according to a seventh embodiment of the present invention. As shown in FIG. 26, the operative joint portion 707 of the present embodiment includes a projection 701 disposed at the center of a top portion of the bridge portion 116 of the body receiver 106 of the first embodiment and a projection receiver 720 formed at the bottom of a body 702.

As shown in FIG. 26, the projection 701 includes an insertion portion 703 having a cylindrical shape extending upward from the bridge portion 116 of the body receiver 106 and an engagement portion 704 in the form of a sphere formed above the insertion portion 703. The projection receiver 720 includes an insertion hole 705 formed in the bottom of the body 702 and a receiver 708 formed above the insertion hole 705 within the body 702. The receiver 708 has a spherical surface 709 corresponding to an outer circumferential surface of the sphere of the engagement portion 704.

With this configuration, the body 702 is coupled to the body receiver 106 by engagement of the engagement portion 704 of the projection 701 and the receiver 708 of the projection receiver 720. Furthermore, the receiver 708 has a spherical surface 709 corresponding to the outer circumferential surface of the sphere of the engagement portion 704. A certain gap is formed between the projection 701 and the projection receiver 720. Therefore, the spherical surface of the engagement portion 704 of the projection 701 is brought into sliding contact with the spherical surface 709 of the receiver 708 while the body 702 is coupled to the body receiver 106. Thus, in the present embodiment, the body 702 can freely move at any angles on the spherical surface of the engagement portion 704 of the projection 701 while the body 702 is coupled to the body receiver 106.

Figure 27:
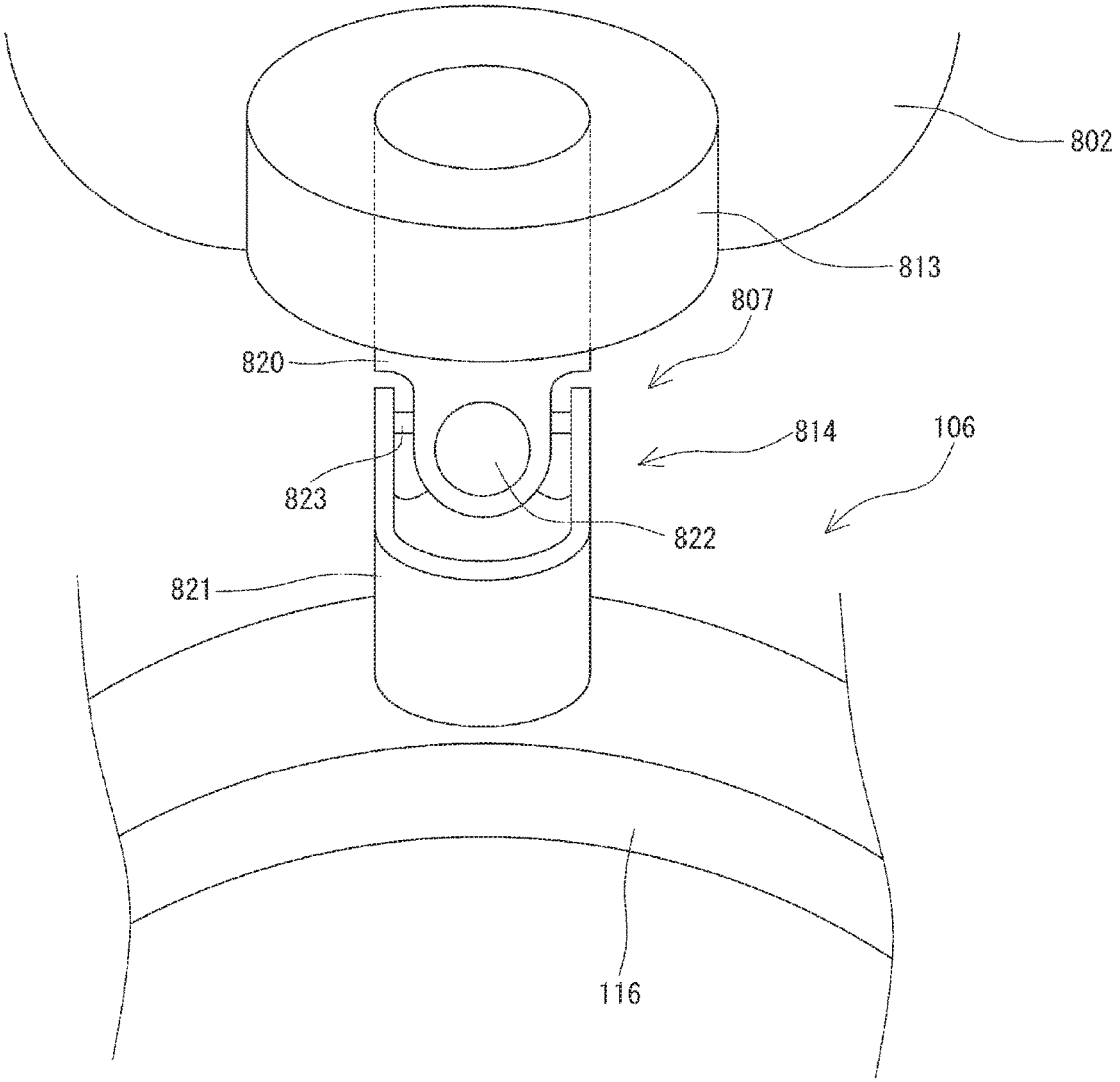
FIG. 27 is a schematic view showing an operative joint portion according to an eighth embodiment of the present invention.

FIG. 27 is a schematic view showing an operative joint portion 807 according to an eighth embodiment of the present invention. As shown in FIG. 27, the operative joint portion 807 of this embodiment includes an annular bearing 813 embedded in the body 802 and a universal joint 814 connecting the bearing 813 and the bridge portion 116 of the body receiver 106 to each other. The universal joint 814 includes a first joint 820 in the form of a cylinder that is fitted in an opening portion of the bearing 813 and a second joint 821 in the form of a cylinder that is fixed on the center of a top portion of the bridge portion 116 of the body receiver 106. The universal joint 814 also includes a first shaft 822 provided on an end of the first joint 820 that is opposite to an end fitted in the bearing 813 and a second shaft 823 provided on an end of the second joint 821 that is opposite to an end fixed to the bridge portion 116.

With such a configuration, the body 802 is rotatable about the first shaft 822 and is rotatable about the second shaft 823 with respect to the body receiver 106. Furthermore, the body 802 is rotatable about a central axis of the bearing 813. Thus, the operative joint portion 807 of the present embodiment couples the body 802 to the body receiver 106 while allowing the body 802 to be rotatable about three axes with respect to the body receiver 106.

In the present embodiment, the bearing 813 is embedded in the body 802, and the second joint 821 is fixed to the body receiver 106. However, the bearing 813 may be provided on the body receiver 106, and the second joint 821 may be provided on the body 802. It is preferable to form the first joint 820 into a cylindrical shape in view of rotating the body 802 with respect to the body receiver 106.

Although certain preferred embodiments of the present invention have been described above, the present invention is not limited to the aforementioned embodiment. It should be understood that various modifications may be made therein without departing from the scope of the technical concept of the present invention. For example, the following embodiments are contemplated.

For example, the strings 104 of the bowed string instrument 1 according to the present invention may be fixed as follows: The strings 104 may be fixed by two pegs 110 provided on an upper side of the upper bridge 108 and on a lower side of the lower bridge 109. Alternatively, the strings 104 may be fixed by a peg 110 provided on an upper side of the upper bridge 108 and a string insertion hole 112 located on a lower side of the lower bridge 109.

The aforementioned embodiments illustrate four tensioned strings 104. The number of tensioned strings 104 may be adjusted depending on a range of tones to be produced by the bowed string instrument 1. For example, the number of tensioned strings may be two or three, or five or more.

In the above embodiments, the shoulder pad 103 is illustrated as having a spherical shape. The shape of the shoulder pad 103 may be formed into a flat plate or a bending shape in order to facilitate the playing or from the viewpoint of design. Furthermore, the shoulder pad 103 is not limited to a member that is brought into contact with a player's shoulder. For example, the shoulder pad 103 may be provided as a member having a roughly hook-like shape that can be slung over a player's shoulder.

Figure 28:
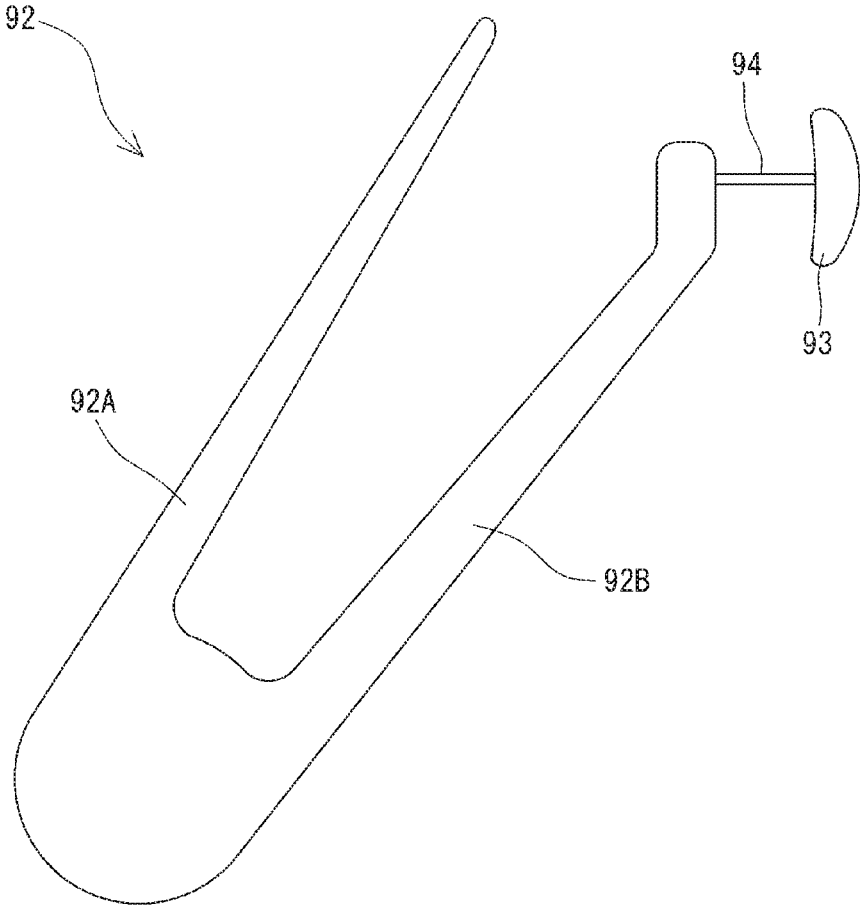
FIG. 28 is a schematic view showing a body and a shoulder pad according to an embodiment of the present invention.

Furthermore, the body of the bowed string instrument according to the present invention can be formed into various shapes. For example, a body 92 as shown in FIG. 28 may be used. The body 92 illustrated in FIG. 28 includes a first member 92A on which a fingerboard (not shown) is mounted and a second member 92B extending upward from a lower end of the first member 92A. Thus, the body 92 is roughly V-shaped. In this case, a shoulder pad 93 may be connected to the body 92 by a connection member 94 such as a collet, a bolt, a screw, and a nut as described above.

Furthermore, an input device such as a pickup or a microphone may be provided on the body of the bowed string instrument as described in the above embodiments. A jack may be formed in the body to externally output electric signals obtained by this input device. Moreover, the body may include therein an amplifier for amplifying electric signals obtained by the input device and a speaker for outputting the amplified electric signals as sounds.

INDUSTRIAL APPLICABILITY

The present invention is suitably used for a bowed string instrument that produces sound by rubbing one or more strings with a bow or the like.

DESCRIPTION OF REFERENCE NUMERALS AND SIGNS

1, 2, 4, 5 bowed string instrument
92, 102 body

93, 103 shoulder pad
104 string
105 fingerboard
106 body receiver
107 operative joint portion
108 upper bridge
109 lower bridge
110 peg
111 curved portion
112 string insertion hole
113 projection receiver
114 projection
115 abutment portion
116 bridge portion
117 bottom
118 liner
119 liner
170 bolt
201 pitch guide portion
202 first inter-string portion
203 second inter-string portion
204 third inter-string portion
205 projection
301 abutment portion
302 curved front surface
303 curved rear surface
304 lower end portion
306 body receiver
401 fixation portion
402 fixation connection portion
403 first connection portion
404 second connection portion
406 body receiver
410 strap
501 separating portion
502 body
503 second joint portion
504 opening portion
507 collet
508 rod
510 first joint portion
601 projection
602 body
603 insertion portion
604 engagement portion
605 insertion hole
606 body receiver
607 operative joint portion
608 receiver
609 center
620 projection receiver
701 projection
702 body
703 insertion portion
704 engagement portion
705 insertion hole
707 operative joint portion
708 receiver
709 spherical surface
720 projection receiver
802 body
807 operative joint portion
813 bearing
814 universal joint
820 first joint
821 second joint
822 first shaft
823 second shaft
906 body receiver
915 abutment portion
916 bridge portion
920 belt-like member

The invention claimed is:

1. A bowed string instrument, comprising:
a body including a fingerboard, a plurality of strings extending above the fingerboard, and a pair of bridges for supporting and tensioning the plurality of strings above the fingerboard;
a shoulder pad connected to the body;
a body receiver disposed below the body so as to receive a load of the body; and
an operative joint portion coupling the body and the body receiver to each other while allowing the body to be slidable on a spherical surface,
wherein the operative joint portion couples the body and the body receiver to each other with a magnetic force.

2. The bowed string instrument as recited in claim 1, wherein the operative joint portion includes:
a projection provided on one of the body and the body receiver, and
a projection receiver provided on another of the body and the body receiver for receiving the projection,
wherein one of the projection and the projection receiver comprises a magnet, and
wherein another of the projection and the projection receiver comprises a magnetic material.

3. A bowed string instrument, comprising:
a body including a fingerboard, a plurality of strings extending above the fingerboard, and a pair of bridges for supporting and tensioning the plurality of strings above the fingerboard;
a shoulder pad connected to the body;
a body receiver disposed below the body so as to receive a load of the body; and
an operative joint portion coupling the body and the body receiver to each other while allowing the body to be slidable on a spherical surface,
wherein the operative joint portion includes:
a projection provided on one of the body and the body receiver, and
a projection receiver provided on another of the body and the body receiver for receiving the projection, and
wherein the operative joint portion couples the body and the body receiver to each other by engagement of the projection and the projection receiver.

4. The bowed string instrument as recited in claim 3, wherein a liner is provided on at least one of the projection and the projection receiver and located between the projection and the projection receiver.

5. A bowed string instrument, comprising:
a body including a fingerboard, a plurality of strings extending above the fingerboard, and a pair of bridges for supporting and tensioning the plurality of strings above the fingerboard;
a shoulder pad connected to the body;
a body receiver disposed below the body so as to receive a load of the body;
an operative joint portion coupling the body and the body receiver to each other while allowing the body to be slidable on a spherical surface;
a separating portion extending on an opposite side of the fingerboard to the plurality of strings in a spaced relationship with the fingerboard; and at least two joint portions coupling the body and the separating portion to each other.

6. A bowed string instrument, comprising:

a body including a fingerboard, a plurality of strings extending above the fingerboard, and a pair of bridges for supporting and tensioning the plurality of strings above the fingerboard;

a shoulder pad connected to the body;

a body receiver disposed below the body so as to receive a load of the body; and an operative joint portion coupling the body and the body receiver to each other while allowing the body to be slidable on a spherical surface, wherein the body receiver includes an abutment portion configured to be brought into abutment against a player's thigh.

7. The bowed string instrument as recited in claim 6, wherein the abutment portion includes at least two bar members.

8. The bowed string instrument as recited in claim 6, wherein the abutment portion includes a contact portion that is brought into contact with at least three points of a player's thigh.

9. The bowed string instrument as recited in claim 6, wherein the abutment portion includes a contact surface that is brought into surface contact with at least part of a player's thigh.

10. The bowed string instrument as recited in claim 6, wherein the abutment portion has lower end portions that are brought into contact with the same plane.

11. The bowed string instrument as recited in claim 6, wherein the operative joint portion couples the body and the body receiver to each other such that the body is rotatable on a curved surface.

12. The bowed string instrument as recited in claim 6, wherein the body further includes at least one pitch guide portion located adjacent to one of the plurality of strings on the fingerboard for indicating pitches of sound to be produced.

13. The bowed string instrument as recited in claim 12, wherein the pitch guide portion is configured so as not to be brought into contact with the adjacent string when the adjacent string is pressed.

14. The bowed string instrument as recited in claim 12, wherein the pitch guide portion is formed of a projection projecting from the fingerboard.

15. The bowed string instrument as recited in claim 6, wherein the body receiver includes:

a fixation portion that can be fixed to a player, and a fixation connection portion connecting the fixation portion and the operative joint portion to each other.

16. A bowed string instrument, comprising:

a body including a fingerboard, a plurality of strings extending above the fingerboard, and a pair of bridges for supporting and tensioning the plurality of strings above the fingerboard;

a shoulder pad connected to the body;

a body receiver disposed below the body so as to receive a load of the body; and an operative joint portion coupling the body and the body receiver to each other while allowing the body to be rotatable about at least one axis with respect to the body receiver, wherein the operative joint portion couples the body and the body receiver to each other with a magnetic force.

17. The bowed string instrument as recited in claim 16, wherein the operative joint portion includes:

a projection provided on one of the body and the body receiver, and a projection receiver provided on another of the body and the body receiver for receiving the projection, wherein one of the projection and the projection receiver comprises a magnet, and wherein another of the projection and the projection receiver comprises a magnetic material.

18. A bowed string instrument, comprising:

a body including a fingerboard, a plurality of strings extending above the fingerboard, and a pair of bridges for supporting and tensioning the plurality of strings above the fingerboard;

a shoulder pad connected to the body;

a body receiver disposed below the body so as to receive a load of the body; and an operative joint portion coupling the body and the body receiver to each other while allowing the body to be rotatable about at least one axis with respect to the body receiver, wherein the operative joint portion includes:

a projection provided on one of the body and the body receiver, and a projection receiver provided on another of the body and the body receiver for receiving the projection, and wherein the operative joint portion couples the body and the body receiver to each other by engagement of the projection and the projection receiver.

19. The bowed string instrument as recited in claim 18, wherein a liner is provided on at least one of the projection and the projection receiver and located between the projection and the projection receiver.

20. A bowed string instrument, comprising:

a body including a fingerboard, a plurality of strings extending above the fingerboard, and a pair of bridges for supporting and tensioning the plurality of strings above the fingerboard;

a shoulder pad connected to the body;

a body receiver disposed below the body so as to receive a load of the body;

an operative joint portion coupling the body and the body receiver to each other while allowing the body to be rotatable about at least one axis with respect to the body receiver;

a separating portion extending on an opposite side of the fingerboard to the plurality of strings in a spaced relationship with the fingerboard; and at least two joint portions coupling the body and the separating portion to each other.

21. A bowed string instrument, comprising:

a body including a fingerboard, a plurality of strings extending above the fingerboard, and a pair of bridges for supporting and tensioning the plurality of strings above the fingerboard;

a shoulder pad connected to the body;

a body receiver disposed below the body so as to receive a load of the body; and an operative joint portion coupling the body and the body receiver to each other while allowing the body to be rotatable about at least one axis with respect to the body receiver, wherein the body receiver includes an abutment portion configured to be brought into abutment against a player's thigh.

22. The bowed string instrument as recited in claim 21, wherein the abutment portion includes at least two bar members.

23. The bowed string instrument as recited in claim 21, wherein the abutment portion includes a contact portion that is brought into contact with at least three points of a player's thigh.

24. The bowed string instrument as recited in claim 21, wherein the abutment portion includes a contact surface that is brought into surface contact with at least part of a player's thigh.

25. The bowed string instrument as recited in claim 21, wherein the abutment portion has lower end portions that are brought into contact with the same plane.

26. The bowed string instrument as recited in claim 21, wherein the operative joint portion couples the body and the body receiver to each other such that the body is rotatable on a curved surface.

27. The bowed string instrument as recited in claim 21, wherein the body further includes at least one pitch guide portion located adjacent to one of the plurality of strings on the fingerboard for allowing a player to know pitches of sound to be produced.

28. The bowed string instrument as recited in claim 27, wherein the pitch guide portion is configured so as not to be brought into contact with the adjacent string when the adjacent string is pressed.

29. The bowed string instrument as recited in claim 27, wherein the pitch guide portion is formed of a projection projecting from the fingerboard.

30. The bowed string instrument as recited in claim 21, wherein the body receiver includes:

a fixation portion that can be fixed to a player, and a fixation connection portion connecting the fixation portion and the operative joint portion to each other.

* * * * *